US011167325B2

(12) United States Patent
Ponomarev

(10) Patent No.: US 11,167,325 B2
(45) Date of Patent: Nov. 9, 2021

(54) METHOD FOR SURFACE CLEANING

(71) Applicant: The Boeing Company, Chicago, IL (US)

(72) Inventor: Sergey G. Ponomarev, Lynnwood, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/930,973

(22) Filed: May 13, 2020

(65) Prior Publication Data

US 2020/0290096 A1 Sep. 17, 2020

Related U.S. Application Data

(62) Division of application No. 14/187,949, filed on Feb. 24, 2014, now Pat. No. 10,688,536.

(51) Int. Cl.

| | |
|---|---|
| ***B08B 3/12*** | (2006.01) |
| ***B08B 7/02*** | (2006.01) |
| ***B08B 5/04*** | (2006.01) |
| ***B08B 7/04*** | (2006.01) |

(52) U.S. Cl.

CPC ..... *B08B 3/12* (2013.01); *B08B 5/04* (2013.01); *B08B 7/026* (2013.01); *B08B 7/028* (2013.01); *B08B 7/04* (2013.01); *B08B 2203/0288* (2013.01)

(58) Field of Classification Search

CPC .... B08B 3/12; B08B 5/02; B08B 5/04; B08B 7/026; B08B 7/028; B08B 2230/01

See application file for complete search history.

(56) References Cited

U.S. PATENT DOCUMENTS

| | | | |
|---|---|---|---|
| 1,538,246 | A | 5/1925 | Kingsbury |
| 1,627,961 | A | 5/1927 | Farley |
| 2,164,924 | A | 7/1939 | Hull |
| 4,069,541 | A | 1/1978 | Williams et al. |
| 4,595,419 | A | 6/1986 | Patenaude |
| 4,768,256 | A | 9/1988 | Motoda |

(Continued)

FOREIGN PATENT DOCUMENTS

| | | |
|---|---|---|
| CN | 102197462 | 9/2011 |
| CN | 103229279 | 7/2013 |

(Continued)

OTHER PUBLICATIONS

JPH06079245—Machine Translation (Year: 1994).*

(Continued)

*Primary Examiner* — Marc Lorenzi

(74) *Attorney, Agent, or Firm* — Walters & Wasylyna LLC

(57) ABSTRACT

A method for cleaning an object having a surface, the method including steps of (1) delivering acoustic waves to the object to dislodge debris from the surface; (2) delivering a cleaning medium to the surface to collect dislodged debris; (3) delivering the acoustic waves to the object to acoustically treat and atomize the cleaning medium and the dislodged debris; (4) applying a vacuum airflow to collect atomized cleaning medium and dislodged debris; (5) delivering a rinsing medium to the surface; (6) delivering the acoustic waves to the object to acoustically treat and atomize the rinsing medium; and (7) applying the vacuum airflow to collect atomized rinsing medium.

20 Claims, 10 Drawing Sheets

(56) References Cited

U.S. PATENT DOCUMENTS

| | | | |
|---|---|---|---|
| 4,890,567 | A | 1/1990 | Caduff |
| 5,297,734 | A | 3/1994 | Toda |
| 5,531,861 | A | 7/1996 | Yu et al. |
| 6,021,785 | A | 2/2000 | Grutzediek et al. |
| 6,186,004 | B1 | 2/2001 | Kaduchak et al. |
| 6,247,525 | B1 | 6/2001 | Smith et al. |
| 6,662,812 | B1 | 12/2003 | Yu et al. |
| 6,810,807 | B2 | 11/2004 | Hebert |
| 8,217,554 | B2 | 7/2012 | Royer, Jr. et al. |
| 8,316,869 | B2 | 11/2012 | Fani et al. |
| 8,327,861 | B2 | 12/2012 | Yin et al. |
| 8,343,421 | B2 | 1/2013 | Krebs et al. |
| 2002/0189633 | A1 | 12/2002 | Nichole Powers et al. |
| 2003/0015218 | A1 | 1/2003 | Bran |
| 2005/0195985 | A1 | 9/2005 | Croft et al. |
| 2005/0236012 | A1 | 10/2005 | Josefsson et al. |
| 2006/0151014 | A1* | 7/2006 | Obweger ..... H01L 21/67057 134/94.1 |
| 2010/0108093 | A1 | 5/2010 | Peng et al. |
| 2010/0258142 | A1* | 10/2010 | Kawaguchi ..... H01L 21/02057 134/1.3 |
| 2011/0135534 | A1 | 6/2011 | Bates et al. |
| 2013/0104936 | A1 | 5/2013 | Ponomarev |
| 2013/0298419 | A1 | 11/2013 | Trevett et al. |
| 2014/0090670 | A1 | 4/2014 | Ponomarev |
| 2014/0096794 | A1 | 4/2014 | Ponomarev |
| 2015/0089754 | A1* | 4/2015 | Chan ..... B08B 17/02 15/94 |
| 2015/0239020 | A1 | 8/2015 | Ponomarev |

FOREIGN PATENT DOCUMENTS

| | | | |
|---|---|---|---|
| DE | 102010028883 | | 11/2011 |
| EP | 0976563 | | 2/2000 |
| EP | 1216642 | | 6/2002 |
| JP | 06079245 | A * | 3/1994 |
| JP | 06262149 | A * | 9/1994 |
| JP | 2002-045807 | | 2/2002 |
| JP | 2006-262149 | | 2/2006 |
| JP | 2009095720 | A * | 5/2009 |
| WO | WO 01/07851 | | 2/2001 |

OTHER PUBLICATIONS

JP2009095720—Machine Translation (Year: 2009).*

JPH06262149—Machine Translation (Year: 1994).*

J.N. Antonevich: "Ultrasonic atomization of liquids," *Ultrasonic Engineering, Transactions of the IRE Professional Group on*, vol. 6, Issue 1, pp. 6-15. http://ieeexplore.ieee.org/xpls/abs all.jsp?arnumber=1538246.

Robert J. Lang: "Ultrasonic atomization of liquids," *J. Acoust. Soc. Am*. vol. 34, Issue 1, pp. 6-8 (1962). http://asadl.org/jasa/resource/1/jasman/v34/i1/p6 s1.

A.J. James et al: "Vibration-induced drop atomization and bursting," *J. Fluid Mech.*, vol. 476, pp. 1-28 (2003). http://www.aem.umn.edu/people/faculty/bio/papers/ajames. JFMFinal1.pdf.

Balasubrahmanyam Avvaru et al: "Ultrasonic Atomization: Effect of liquid phase properties." *Ultrasonics*, vol. 44, pp. 146-158 (2006). http://www.sciencedirect.com/science/article/pii/S0041624X05000983.

Doris Schultz: "Auto Clean," *Cutting Tool Engineering*, vol. 63, Issue 6 (2011). http://www.ctemag.com/aa_pages/2011/110629-PartsCleaning.html.

J.A. Gallego-Juarez et al.: Advances in the development of power ultrasonic technologies based on the stepped plate transducers. 36$^{th}$ UIA Annual Symposium, 2007 England. http://www.ultrasonics_.org/Proceedings_2007_UIA/Gallego_2007_UIA.pdf.

E. Riera-Franco de Sarabia et al.: "Application of high power ultrasound for drying vegetables." 19$^{th}$ International Congress on Acoustic, Madrid, Spain (2007). http://digital.csic.es/bitstream/10261/7957/1/ult05004.pdf.

McLaren is Using Fighter Jet Technology for Wiper Free Windsheilds: http://gizmodo.com/mclaren-is-using-fighter-jet-technology-for-wiper-free-1484213049.

European Patent Office, "Communication pursuant to Article 94(3) EPC," App. No. 15 708 362.7 dated Mar. 31, 2021.

* cited by examiner

METHOD FOR SURFACE CLEANING

PRIORITY

This application is a divisional of U.S. Ser. No. 14/187,949 filed on Feb. 24, 2014.

FIELD

The present disclosure is generally related to surface cleaning and, more particularly, to systems and methods employing cleaning mediums, acoustic waves and vacuum suction to remove debris from a surface of an object.

BACKGROUND

Besides just aesthetic appearance, cleaning the surfaces of objects (e.g., workpieces or other manufactured parts) is an essential, and in many applications required, process to prepare the part for further processing, such as applying a new finish or assembling the part into a larger component. The choice of cleaning methods may depend on many factors, such as the nature of the contamination, the degree of the contamination, cleanliness requirements, and the shape, size or complexity of the object.

Conventional cleaning methods have various limitations, such as inconsistent cleaning quality and certain surfaces (e.g., complex surfaces or interior surfaces) may be difficult to reach or access.

Accordingly, those skilled in the art continue with research and development efforts in the field of surface cleaning of objects.

SUMMARY

In one aspect, the disclosed system for cleaning an object may include an acoustic device configured to deliver acoustic waves to the object, a cleaning medium dispenser configured to deliver a cleaning medium to a surface of the object, a rinsing medium dispenser configured to deliver a rinsing medium to the surface, a vacuum configured to deliver a vacuum airflow proximate to the surface, wherein the acoustic waves generate acoustic vibrations in the object to dislodge debris from the surface, acoustically treat the cleaning medium and the rinsing medium, and atomize the cleaning medium, the debris collected by the cleaning medium and the rinsing medium.

In another aspect, the disclosed system for cleaning an object may include an acoustic device configured to deliver acoustic waves to the object, a fluid dispenser configured to deliver a fluid to the surface, a vacuum configured to deliver a vacuum airflow proximate the surface, wherein the acoustic waves dislodge debris from the surface, acoustically treat the fluid, and atomize the fluid and the debris collected by the fluid.

In another aspect, the disclosed system may include an acoustic device configured to deliver acoustic waves to the object, a cleaning medium dispenser configured to deliver a cleaning medium to the surface, a rinsing medium dispenser configured to deliver a rinsing medium to the surface, and a vacuum configured to deliver a vacuum airflow proximate the surface, wherein the acoustic waves generate acoustic vibrations in the object to dislodge debris from the surface, acoustically treat the cleaning medium and the rinsing medium, and atomize the cleaning medium, the debris collected by the cleaning medium and the rinsing medium.

In yet another aspect, disclosed is a method for cleaning an object, the method may include the steps of: (1) delivering acoustic waves to the object to dislodge debris from the surface, (2) delivering a cleaning medium to the surface to collect dislodged debris, (3) delivering the acoustic waves to the object to acoustically treat and atomize the cleaning medium and the dislodged debris, (4) applying a vacuum airflow to collect atomized cleaning medium and dislodged debris, (5) delivering a rinsing medium to the surface, (6) delivering the acoustic waves to the object to acoustically treat and atomize the rinsing medium, and (7) applying a vacuum airflow to collect atomized rinsing medium Other aspects of the disclosed system and method will become apparent from the following detailed description, the accompanying drawings and the appended claims.

DETAILED DESCRIPTION

Figure 1:
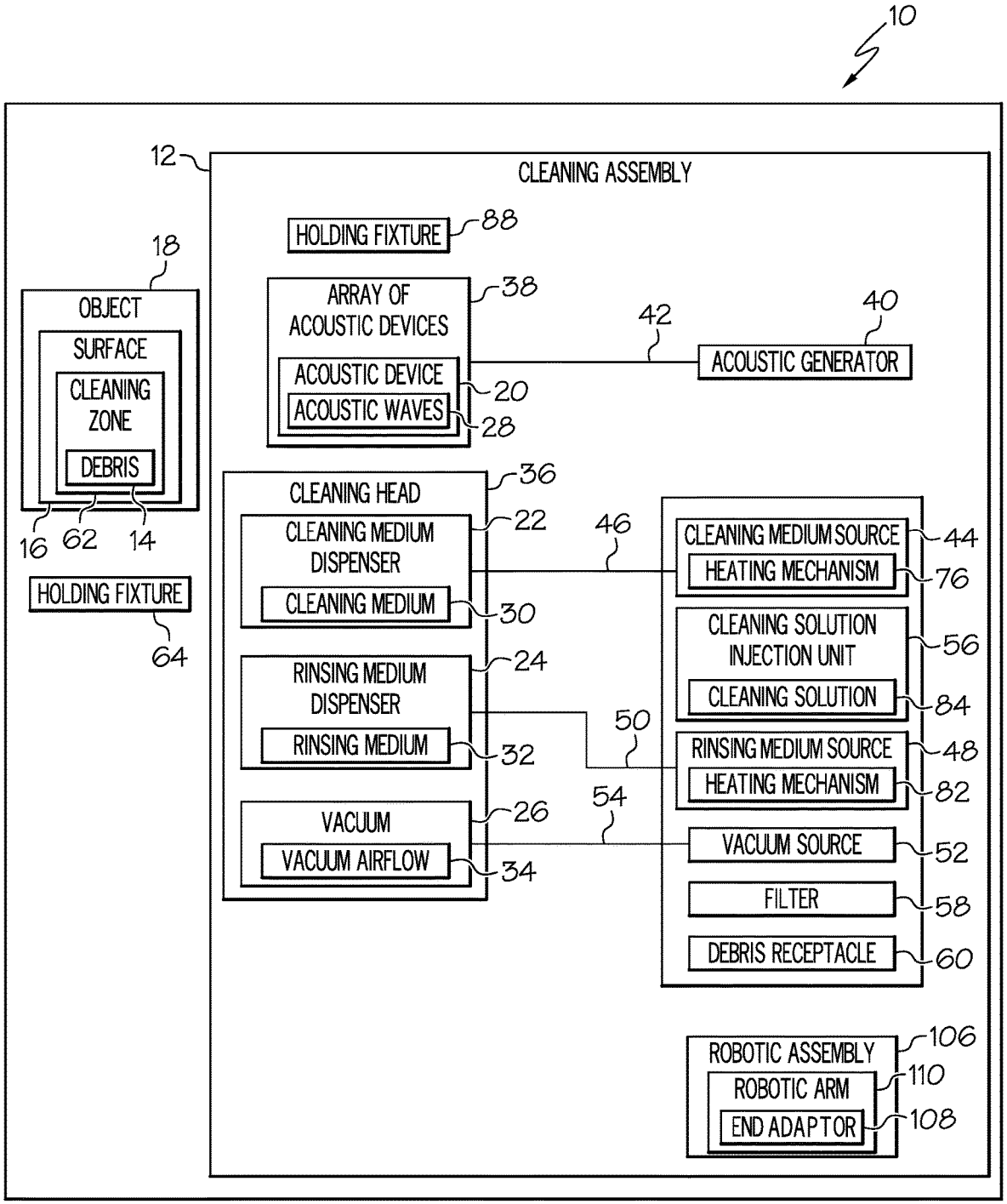
FIG. 1 is a block diagram illustrating one aspect of the disclosed system for cleaning an object.

The following detailed description refers to the accompanying drawings, which illustrate specific aspects of the disclosure. Other aspects having different structures and operations do not depart from the scope of the present disclosure. Like reference numerals may refer to the same element or component in the different drawings.

Referring to FIG. 1, one aspect of the disclosed system, generally designated 10, for surface cleaning of an object may include a cleaning assembly 12 utilized for cleaning debris 14 from one or more surfaces 16 of one or more objects 18, such as during fabrication, assembly and/or maintenance of the object 18. For example, the object 18 may include any manufactured part, component, assembly or sub-assembly having large, complex and/or delicate surfaces 16, including, but not limited to, complex three-dimensional objects 18 and/or large two-dimensional objects 18, such as aircraft components.

As used herein, debris 14 may include any contaminant, substance and/or other unwanted constituent material disposed on the surface 16 of the object 18. Debris 14 may include any solid, semi-solid, liquid and/or semi-liquid material of any type, without limitation.

The cleaning assembly 12 may include at least one acoustic device 20, at least one cleaning medium dispenser 22, at least one rinsing medium dispenser 24 and at least one vacuum 26. The acoustic device 20 may deliver acoustic (e.g., sound) waves 28 to the surface 16 of the object 18 to generate vibrations on the surface 16 of the object 18 and/or within (e.g., throughout at least a portion of) the object 18. The cleaning medium dispenser 22 may deliver a cleaning medium 30 to the surface 16 of the object 18. The rinsing medium dispenser 24 may deliver a rinsing medium 32 to the surface 16 of the object 18. The vacuum 26 may deliver a vacuum airflow 34 (e.g., vacuum suction) proximate (e.g., at or near) and/or directed to the surface 16 of the object 18.

The acoustic vibrations on the surface 16 of the object 18 and/or through the object 18 may dislodge the debris 14 from the surface 16 of the object 18. For example, the acoustic vibrations may reduce adhesion between the debris 14 and the surface 16 and/or break up the debris 14 into smaller particles of debris 14 (e.g., particulate material). The cleaning medium 30 may absorb, capture and/or suspend any debris 14 dislodged from the surface 16 of the object 18 in response to the vibrational effects of the acoustic waves 28. The acoustic vibrations on the surface 16 of the object 18 and/or through the object 18 may atomize the cleaning medium 30 and any dislodged debris 14 (e.g., particles of debris 14 captured within a cleaning medium envelope). The rinsing medium 32 may rinse away any cleaning medium 30 and debris 14 remaining on the surface 16. The acoustic vibrations on the surface 16 of the object 18 and/or through the object 18 may atomize the rinsing medium 32. The vacuum 26 may remove the atomized cleaning medium 30 along with any debris 14 collected by the cleaning medium 30 and the atomized rinsing medium 32 from the surface 16 of the object 18.

The acoustic device 20 may include a sonic device configured to emit sonic waves that generate acoustic (specifically, sonic) vibrations in the object 18 and/or an ultrasonic device configured to emit ultrasonic waves that generate acoustic (specifically, ultrasonic) vibrations in the object 18. As used herein the terms sonic waves and ultrasonic waves may refer to oscillating mechanical waves (e.g., pressure waves), wherein the frequencies of the mechanical waves may vary from a few hertz to billions of hertz. For example, sonic waves may include waves having a frequency between approximately 1,000 Hz and 10,000 Hz. As another example, ultrasonic waves may include waves having a frequency between approximately 20 kHz and 20 MHz.

Those skilled in the art will appreciate that the vibrational effects of the sonic waves and/or ultrasonic waves utilized to atomize droplets of cleaning medium 30 and/or rinsing medium 32 into a mist are not related to human hearing and, as such, the terms sonic and ultrasonic are not necessarily limited by common definition.

One or more acoustic devices 20 (e.g., sonic devices and/or ultrasonic devices) may be positioned at various locations with respect to the object 18 and tuned to generate various types of acoustic (e.g., sonic and/or ultrasonic) guided wave modes, including acoustic streaming (e.g., movement of the cleaning medium 30 and/or the rinsing medium 32 in response to the acoustic waves 28), on the surface 16 of the object 18 at desired locations. In an example implementation, one or more acoustic devices 20 may be air coupled to (e.g., proximate to) the object 18 and/or the surface 16 of the object 18. In another example implementation, one or more acoustic devices 20 may be physically coupled to (e.g., in contact with) the object 18 and/or the surface 16 of the object 18. In yet another example implementation, one or more acoustic devices 20 may be air coupled to the object 18 and/or the surface 16 of the object 18 and one or more acoustic devices 20 may be physically coupled to the object 18 and/or the surface 16 of the object 18.

The acoustic device 20 may be any suitable acoustic transducer that generates acoustic signals when driven by an electric voltage. In an example construction, the acoustic device 20 may be a piezoelectric transducer (e.g., a sonic transducer or an ultrasonic transducer) that converts electrical energy into acoustic energy (e.g., sound). Piezoelectric crystals may change size when a voltage is applied, thus applying an alternating current ("AC") across the piezoelectric transducer may cause it to oscillate at a very high frequency and produce very high frequency sound waves (e.g., acoustic waves 28).

A plurality of acoustic devices 20 (e.g., a plurality of sonic devices and/or ultrasonic devices) may be arranged in an array 38 of acoustic devices 20. The array 38 may be any arrangement of acoustic devices 20 connected to common source (e.g., acoustic generator 40). In one example, the plurality of acoustic devices 20 may be arranged in a parametric array of acoustic devices. In another example, the plurality of acoustic devices 20 may be arranged in a phased array of acoustic devices. The array 38 of acoustic devices 20 may include a geometry that directs and concentrates the acoustic waves 28 onto particular areas (e.g., cleaning zones 62) on the surface 16 of the object 18 to be cleaned.

As used herein, a parametric array may include a plurality of acoustic devices 20 (e.g., high-intensity piezoelectric transducers) configured to produce a narrow primary beam of sound (e.g., acoustic waves 28). In general, the larger the dimensions of the parametric array, the narrower the beam. As a general, non-limiting example, the parametric array may be driven at two closely spaced ultrasonic frequencies (e.g., $\omega 1$ and $\omega 2$) at high enough amplitudes to produce a difference frequency (e.g., $\omega 2-\omega 1$).

As used herein, a phased array may include a plurality of acoustic devices 20 (e.g., piezoelectric transducers) individually connected so that the signals they transmit or receive may be treated separately or combined as desired. For example, multiple acoustic devices 20 may be arranged in patterns in a common housing. The patterns may include, but are not limited to, linear, matrix, and/or annular in shape. The acoustic devices 20 may be pulsed simultaneously or independently of each other in varying patterns to achieve specific beam characteristics.

An acoustic generator 40 may be coupled to the acoustic devices 20. The acoustic generator 40 (e.g., a sonic and/or ultrasonic power amplifier and function generator) may supply energy to the acoustic devices 20. An acoustic supply line 42 (e.g., a flexible acoustic waveguide) may couple the acoustic generator 40 to the acoustic devices 20 such that acoustic waves 28 may be applied from the acoustic devices 20 to the surface 16 of the object 18 (e.g., about the cleaning zone 62).

The cleaning medium dispenser 22, the rinsing medium dispenser 24 and/or the vacuum 26 may be mounted to a cleaning head 36. The cleaning head 36 may deliver cleaning medium 30 (e.g., from the cleaning medium dispenser 22), rinsing medium 32 (e.g., from the rinsing medium dispenser 24) and vacuum airflow 34 (e.g., from the vacuum 26) directly to a cleaning zone 62 on the surface 16 of the object 18.

A cleaning medium source 44 may be fluidly coupled to the cleaning head 36. The cleaning medium source 44 may supply the cleaning medium 30 to the cleaning medium dispenser 22. A cleaning medium supply line 46 may fluidly couple the cleaning medium source 44 to the cleaning head 36 such that cleaning medium 30 may be provided from the cleaning medium dispenser 22 to the surface 16 of the object 18 (e.g., about the cleaning zone 62).

A rinsing medium source 48 may be fluidly coupled to the cleaning head 36. The rinsing medium source 48 may supply the rinsing medium 32 to the rinsing medium dispenser 24. A rinsing medium supply line 50 may fluidly couple the rinsing medium source 48 to the cleaning head 36 such that rinsing medium 32 may be provided from the rinsing medium dispenser 24 to the surface 16 of the object 18 (e.g., about the cleaning zone 62).

The cleaning medium 30 may include any suitable substance and/or material that are able to perform a cleaning action in combination with the ultrasonic waves 28 and vacuum airflow 34. The rinsing medium 32 may include any suitable substance and/or material that are able to perform a rinsing action in combination with the ultrasonic waves 28 and vacuum airflow 34.

The cleaning medium 30 may include any cleaning fluid. The cleaning fluid may include a liquid or a gas. As an example, the cleaning medium 30 may include liquid water (e.g., hot water and/or cold water). As another example, the cleaning medium 30 may include any aqueous solutions (e.g., organic solvents, surfactants, detergents or other chemicals). As another example, the cleaning medium 30 may be steam (e.g., vaporized water). As another example, the cleaning medium 30 may be air (e.g., forced and/or pressurized air). As another example, the cleaning medium 30 may include a blasting media (e.g., solid plastic pellets, sand, gel capsules, liquid CO2, solid CO2, and the like). As yet another example, the cleaning medium 30 may include any combination of cleaning fluids and/or blasting media.

The rinsing medium 32 may include any rinsing fluid. The rinsing fluid may include a liquid or a gas. As an example, the rinsing medium 32 may include liquid water (e.g., hot water and/or cold water). As another example, the rinsing medium 32 may include any aqueous solutions (e.g., organic solvents, surfactants, detergents or other chemicals). As another example, the rinsing medium 32 may be steam (e.g., vaporized water). As another example, the rinsing medium 32 may be air (e.g., forced and/or pressurized air). As yet another example, the rinsing medium 32 may include any combination of rinsing fluids.

A vacuum source 52 may be fluidly coupled to the cleaning head 36. The vacuum source 52 may supply the vacuum airflow 34 (e.g., vacuum suction) to the vacuum 26. A vacuum supply line 54 may fluidly couple the vacuum source 52 to the cleaning head 36 such that vacuum suctioning (e.g., vacuum airflow 34) may be applied from the vacuum 26 to the surface 16 of the object 18 (e.g., about the cleaning zone 62).

The acoustic waves 28 may promote and/or facilitate both removal of debris 14 and acoustic treatment of the cleaning medium 30 and rinsing medium 32 to atomize the cleaning medium 30 and rinsing medium 32 from the surface 16 of the object 18 (e.g., about the cleaning zone 62). Acoustic treatment may include any treatment of an object with acoustic energy.

Thus, the removal (e.g., cleaning and rinsing) of debris 14 may be achieved by the combination of the acoustic waves 28, the cleaning medium 30, the rinsing medium 32 and the vacuum airflow 34 and, therefore, may be completely non-contact. For example, the acoustic devices 20, the cleaning medium dispenser 22, the rinsing medium dispenser 24 and the vacuum 26 may be positioned at a distance (e.g., spaced away) from the object 18 to be cleaned and do not impose any risk of contamination of the surface 16 of the object 18. More particularly, the acoustic devices 20, the cleaning medium dispenser 22, the rinsing medium dispenser 24 and the vacuum 26 may be positioned in close proximity to the surface 16 of the object 18

As used herein, close proximity may include a position close to the surface 16 of the object 18 without touching the object 18. As an example, close proximity may include positions of at most approximately 12 inches from the surface 16. As another example, close proximity may include positions of at most approximately 6 inches from the surface 16. As another example, close proximity may include positions of at most approximately 3 inches from the surface 16. As another example, close proximity may include positions of at most approximately 1 inch from the surface 16. As yet another example, close proximity may include positions as close to the surface 16 as possible without contacting the surface 16.

Those skilled in the art will appreciate that the proximity to the surface 16 of the object 18 may depend upon the size, power and/or configuration of the acoustic devices 20, the cleaning medium dispenser 22, the rinsing medium dispenser 24 and the vacuum 26 in order to effectively perform a cleaning operation.

The acoustic waves 28 (e.g., beams of focused acoustic energy) may radiate and sweep across the surface 16 of the object 18 while, at the same time, the cleaning medium 30 is delivered onto the surface 16, for example, in the form of droplets and/or a thin film. Within the droplets and/or the thin film of cleaning medium 30, the acoustic energy from the acoustic waves 28 may create micro-streaming forces, dynamic fluid boundaries and other microfluidic capabilities that lead to the formation of airborne mist particulates of the cleaning medium 30 and the debris 14. At the same time, the acoustic waves 28 may additionally energize the cleaning medium 30 and the rinsing medium 32 and transfer the acoustic energy down to the droplets and/or thin film of cleaning medium 30 and rinsing medium 32 delivered onto the surface 16. Thus, the acoustic vibrations generated by the acoustic waves 28 may perform the cleaning action. The cleaning action may be accomplished by forming an airborne mist (e.g., atomized or aerosolized) of cleaning medium 30 having particulates of debris 14 suspended therein and/or rinsing medium 32.

The acoustic waves 28 may be modulated, such that the interaction of the modulated acoustic waves 28 with the object 18 and an air medium (e.g., air between the acoustic devices 20 and the surface 16 of the object 18) generates desired patterns of acoustic vibrations. For example, the acoustic devices 20 may generate acoustic waves 28 having different frequencies and/or amplitudes such that when the acoustic waves 28 impinge on the object 18, desired patterns of acoustic vibrations may be generated in the air medium, on the surface 16 of the object 18 and/or in the object 18.

Specific acoustic mode and frequency excitation over a frequency range (e.g., from 1 Hz to 500 MHz) may be provided, wherein frequency tuning over a selected frequency range may be achieved by optimally positioning the acoustic devices 20 and/or by modal vibration combinations. Those skilled in the art will appreciate that how the acoustic waves 28 (e.g., acoustic vibrations and acoustic stresses generated by the acoustic waves 28) are focused to effectively break up and/or dislodge debris 14 and atomize cleaning medium 30 and particulate debris 14 and rinsing medium 32 from the surface 16 of the object 18 may depend on the particular cleaning operation. For example, the type of debris 14, the thickness of the debris 14, the structural geometry of the object 18, environmental conditions and the like may affect the configuration of the acoustic devices 20.

As an example, the frequency of one or more of the ultrasonic devices 20 may be tuned to a particular frequency or frequency range depending upon the particle size of the debris 14. As an example, relatively low frequencies (e.g., below approximately 20 kHz) may atomize the cleaning medium 30 into a relatively large mist (e.g., approximately 10 microns and above). Thus, the mist of atomized cleaning medium 30 may capture relatively large particles of debris 14 (e.g., approximately 10 microns and above). As another example, relatively high frequencies (e.g., above approximately 1 MHz) may atomize the cleaning medium 30 into a relatively small mist (e.g., approximately 3 microns and below). Thus, the mist of atomized cleaning medium 30 may capture relatively small particles of debris 14 (e.g., approximately 3 microns and below).

As another example, the frequency of one or more of the ultrasonic devices 20 may be tuned to a particular frequency or frequency range depending upon the size and/or shape of the surface 16 to be cleaned. As an example, large and/or generally flat surfaces may have relatively large particles of debris 14 (e.g., approximately 10 microns and above). Thus, relatively low frequencies (e.g., below approximately 20 kHz) may be used to atomize the cleaning medium 30 and the debris 30 and/or the rinsing medium 32 from the surface 16. As another example, small and/or complex surfaces may have relatively small particles of debris 14 (e.g., approximately 3 microns and below). Thus, relatively high frequencies (e.g., above approximately 1 MHz) may be used to atomize the cleaning medium 30 and the debris 14 and/or the rinsing medium 32 from the surface 16.

The initial patterns generated by the acoustic waves 28 may be complex but eventually, after many reflections and as the acoustic waves 28 travel from one boundary to another, a modal pattern may be established at a resonant frequency. There may be many resonant frequencies fairly close together because of acoustic excitation. Removal of the cleaning medium 30 and the debris 14 and/or the rinsing medium 32 may often occur at a resonant or a non-resonant situation.

Various types of guided ultrasonic wave modes and stress focal points may be created on the surface 16 of the object 18 at desired locations (e.g., the cleaning zone 62) by placing, activating and tuning the acoustic devices 20 to form an acoustically resonating system. The acoustically resonating system may deliver the desired patterns of acoustic vibrations to the entire object 18, which, for example, may be mounted to or fixed with a holding fixture 64. Air coupled acoustic devices 20, which are located outside the object 18, may create the desired patterns of acoustic vibrations directed about the cleaning zone 62. Focusing acoustic stresses may be achieved electronically (e.g., tuning the acoustic devices 20) and/or mechanically (e.g., positioning the acoustic devices 20). Air-coupled and/or physically coupled, arrays 38 (e.g., parametric arrays and/or phased arrays) of acoustic devices 20 may be specifically configured to impinge acoustic vibrations on complex three-dimensional objects 18 to facilitate removal of debris 14 and atomization of cleaning medium 30 containing the debris 14 (e.g., particles of debris) and the rinsing medium 32.

Figure 2:
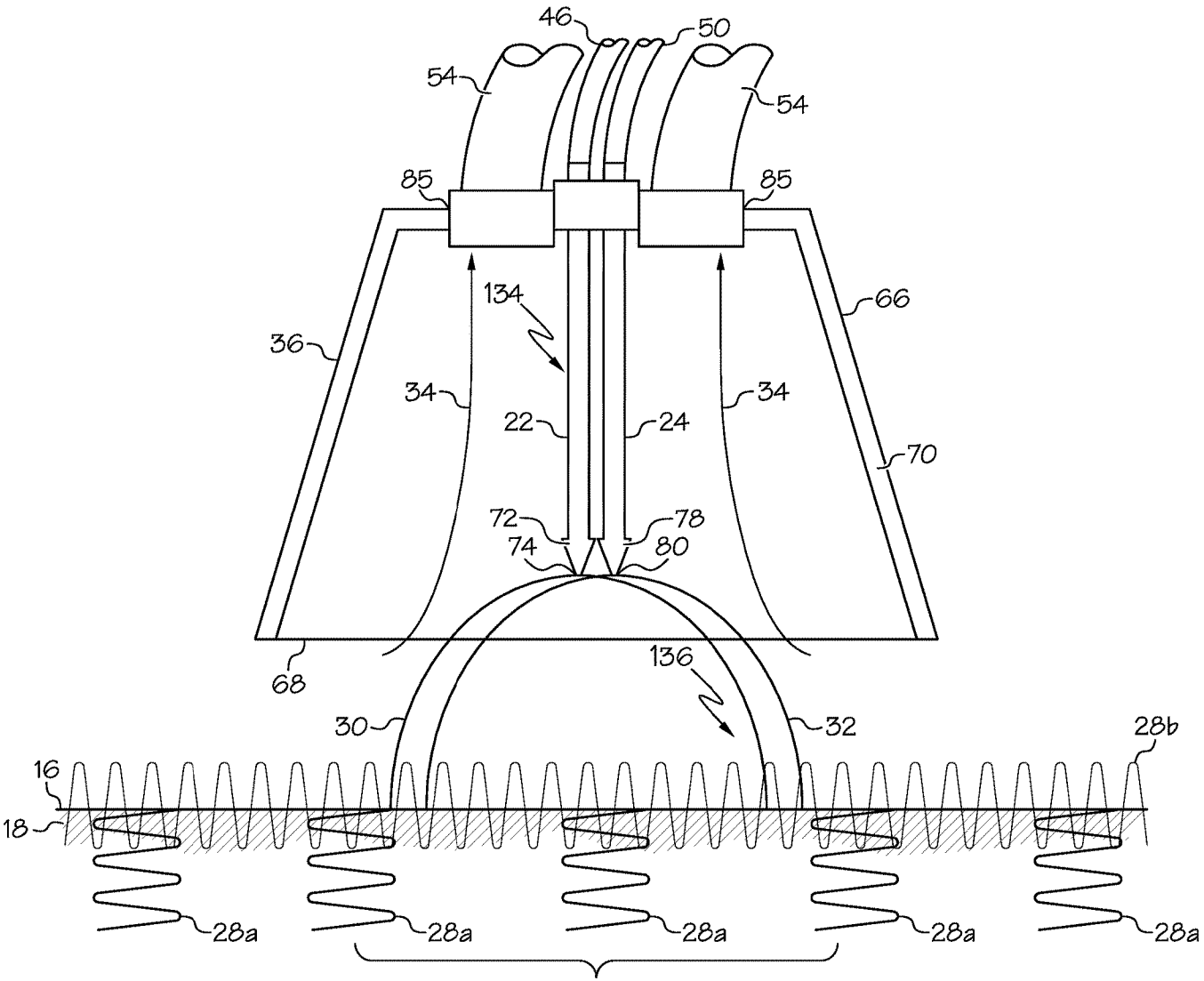
FIG. 2 is a schematic illustration of one aspect of the cleaning head employed by the disclosed system.

Referring to FIG. 2, the cleaning head 36 may include a vacuum chamber 66 having an open end 68. For example, a plurality of sidewalls 70 may define a partially enclosed vacuum chamber 66 having a rectangular cross-sectional shape. As another example, a continuous sidewall 70 may define a partially enclosed vacuum chamber 66 having an annular cross-sectional shape. The vacuum chamber 66 may be sized and configured according to a given cleaning operation and/or application, such as the size of the object 18, the shape of the object 18 and/or the complexity of the object 18. Similarly, the size of the cleaning zone 62 may be determined by the size and/or configuration of the cleaning head 36 (e.g., the area covered by the cleaning medium 30, the rinsing medium 32 and the vacuum airflow 34) and/or the area covered by the acoustic waves 28.

The cleaning medium dispenser 22 may be located within the vacuum chamber 66 at an orientation sufficient to deliver the cleaning medium 30 to the surface 16 of the object 18. The cleaning medium dispenser 22 may include a nozzle 72 fluidly coupled to the cleaning medium supply line 46. The nozzle 72 may include a nozzle outlet 74 configured to discharge the cleaning medium 30 directly into the vacuum chamber 66 and/or on the surface 16 of the object 18 (e.g., within the cleaning zone 62). The cleaning medium 30 may facilitate the removal of particulate debris 14 (FIG. 1) dislodged from the surface 16 of the object 18 by the acoustic vibrations on the surface 16 of the object 18 and/or within the object 18.

The cleaning medium dispenser 22 (e.g., the nozzle 72) may be configured to discharge cleaning medium 30 in a manner such that one or more surfaces 16 of the object 18 may be exposed to the cleaning medium 30 to capture dislodged debris 14 (FIG. 1) from the surface 16 of the object 18. For example, the nozzle 72 may be configured to discharge cleaning medium 30 along a generally axial direction toward one or more surfaces 16 of the object 18 proximate (e.g., at or near) the open end 68 of the vacuum chamber 66. However, the nozzle 72 may be configured to discharge cleaning medium 30 in any one of a variety of directions and/or angles. As another example, the nozzle outlet 74 may be configured to discharge the cleaning medium 30 in the form of a stream or a spray having various cross-sectional dimensions to apply droplets or a thin film of cleaning medium 30 to the surface 16. However, the nozzle outlet 74 may be configured to discharge the cleaning medium 30 in any one of a variety of forms and/or dimensions.

Although a single nozzle 72 with a single nozzle outlet 74 is shown, any number of nozzles 72 and/or nozzle outlets 74 in any size and location may be provided. For example, a plurality of nozzles 72 and/or a plurality of nozzle outlets 74 may extend into the vacuum chamber 66 at different locations to provide a more uniform distribution of cleaning medium 30 about the cleaning zone 62. Further, although the nozzle 72 is illustrated as being fluidly coupled to an end (e.g., opposite the open end 68) of the vacuum chamber 66, one or more nozzles 72 may be included to provide cleaning medium 30 from one or more locations along the sidewalls 70 of the vacuum chamber 66 (e.g., proximate the open end 68).

In an example implementation, the cleaning medium 30 may be water (e.g., hot water), the cleaning medium dispenser 22 may include a nozzle 72 suitable to discharge water (e.g., in the form of a drip, a stream, a spray or a mist), the cleaning medium supply line 46 may be a water supply line, and the cleaning medium source 44 may be a water source (e.g., water tank). Optionally, the cleaning medium source 44 may include a heating mechanism 76 (FIG. 1) to heat the cleaning water to a desired cleaning temperature.

The temperature and/or the pressure of the cleaning medium 30 (e.g., water temperature and/or pressure) may be regulated, adjusted and/or otherwise controlled to correspond to a given cleaning operation. For example, the temperature may of the cleaning medium 30 be controlled to provide cleaning medium 30 at a temperature that may avoid heat damage to the material composition of the object 18 and/or the surface 16 being cleaned. Similarly, the pressure of the cleaning medium 30 may be regulated (e.g., by means of a valve or the configuration of the nozzle outlet 74) such that cleaning medium 30 may be discharged from the nozzle outlet 74 in a manner that the velocity of the cleaning medium 30 is high enough to contact the surface 16 of the object 18 prior to atomization of the cleaning medium 30 (e.g., by the acoustic waves 28) and vacuum suctioning of the cleaning medium 30 and any collected debris 14 into the vacuum 26 (FIG. 1). Control of cleaning medium 30 from the cleaning medium source 44 (FIG. 1) may be preprogrammed and/or automatically controlled.

The rinsing medium dispenser 24 may be located within the vacuum chamber 66 at an orientation sufficient to deliver the rinsing medium 32 to the surface 16 of the object 18. The rinsing medium dispenser 24 may include a nozzle 78 fluidly coupled to the rinsing medium supply line 50. The nozzle 78 may include a nozzle outlet 80 configured to discharge the rinsing medium 32 directly into the vacuum chamber 66 and/or on the surface 16 of the object 18 (e.g., within the cleaning zone 62). The rinsing medium 32 may facilitate the removal of any cleaning medium 30 (and any particulate debris 14) remaining on the surface 16 of the object 18. The rinsing medium 32 may be atomized by the acoustic vibrations on the surface 16 of the object 18 and/or within the object 18.

The rinsing medium dispenser 24 (e.g., the nozzle 78) may be configured to discharge rinsing medium 32 in a manner such that one or more surfaces 16 of the object 18 may be exposed to the rinsing medium 32 to rinse the surface 16 of the object 18. For example, the nozzle 78 may be configured to discharge rinsing medium 32 along a generally axial direction toward one or more surfaces 16 of the object 18 proximate the open end 68 of the vacuum chamber 66. However, the nozzle 78 may be configured to discharge rinsing medium 32 in any one of a variety of directions and/or angles. As another example, the nozzle outlet 80 may be configured to discharge the rinsing medium 32 in the form of a stream or a spray having various cross-sectional dimensions to apply droplets or a thin film of rinsing medium 32 to the surface 16. However, the nozzle outlet 80 may be configured to discharge the rinsing medium 32 in any one of a variety of forms and/or dimensions.

Although a single nozzle 78 with a single nozzle outlet 80 is shown, any number of nozzles 78 and/or nozzle outlets 80 in any size and location may be provided. For example, a plurality of nozzles 78 and/or a plurality of nozzle outlets 80 may extend into the vacuum chamber 66 at different locations to provide a more uniform distribution of rinsing medium 32 about the cleaning zone 62. Further, although the nozzle 78 is illustrated as being fluidly coupled to an end (e.g., opposite the open end 68) of the vacuum chamber 66, one or more nozzles 78 may be included to provide rinsing medium 32 from one or more locations along the sidewalls 70 of the vacuum chamber 66 (e.g., proximate the open end 68).

In an example implementation, the rinsing medium 32 may be water (e.g., hot water), the rinsing medium dispenser 24 may include a nozzle 78 suitable to discharge water (e.g., in the form of a drip, a stream, a spray or a mist), the rinsing medium supply line 50 may be a water supply line, and the rinsing medium source 48 may be a water source (e.g., water tank). Optionally, the rinsing medium source 48 may include a heating mechanism 82 (FIG. 1) to heat the rinsing water to a desired cleaning temperature.

The temperature and/or the pressure of the rinsing medium 32 (e.g., water temperature and/or pressure) may be regulated, adjusted and/or otherwise controlled to correspond to a given cleaning operation. For example, the temperature may of the rinsing medium 32 be controlled to provide rinsing medium 32 at a temperature that may avoid heat damage to the material composition of the object 18 and/or the surface 16 being cleaned. Similarly, the pressure of the rinsing medium 32 may be regulated (e.g., by means of a valve or the configuration of the nozzle outlet 80) such that rinsing medium 32 may be discharged from the nozzle outlet 80 in a manner that the velocity of the rinsing medium 32 is high enough to contact the surface 16 of the object 18 and rinse away any remaining cleaning medium 30 (and any remaining particles of debris 14) prior to atomization of the rinsing medium 32 (e.g., by the acoustic waves 28) and vacuum suctioning of the rinsing medium 32 into the vacuum 26 (FIG. 1). Control of rinsing medium 32 from the rinsing medium source 48 (FIG. 1) may be preprogrammed and/or automatically controlled.

Although the cleaning medium dispenser 22 and the rinsing medium dispenser 24 are shown as being discrete components, the cleaning medium 30 and the rinsing medium 32 may be delivered (e.g., dispensed) from a single (e.g., common) fluid dispenser, generally designated 134 (FIG. 2). As an example, two different fluids, generally designated 136, (e.g., the cleaning medium 30 and the rinsing medium 32) may be used for cleaning and rinsing the surface 16, respectively. The two fluids 136 may include different compositions. Two different fluid supply lines (e.g., the cleaning medium supply line 46 and the rinsing medium supply line 50) may be fluidly coupled between two different fluid sources (e.g., the cleaning medium source 44 and the rinsing medium source 48) and the single fluid dispenser 134. As another example, a single fluid 136 (e.g., the cleaning medium 30 and the rinsing medium 32) may be used for both cleaning and rinsing the surface 16. A single fluid supply line (not shown) may be fluidly coupled between a single fluid source (not shown) and the single fluid dispenser 134.

Removing debris 14 from the surface 16 (e.g., a cleaning operation) may include two stages, namely a cleaning stage and a rinsing stage. During the cleaning stage, the cleaning medium 30 is delivered to the surface 16 and is subsequently atomized by the acoustic waves 28 delivered by the acoustic devices 20. During the rinsing stage, the rinsing medium 32 is delivered to the surface 16 and is subsequently atomized by the acoustic waves 28. In an example implementation, one or more cleaning stages and one or more rinsing stages may occur separately and consecutively (e.g., the rinsing stage begins after completion of the cleaning stage). As another example, one or more cleaning stages and one or more rinsing stages may occur simultaneously. As yet another example, one or more cleaning stages and one or more rinsing stages may overlap (e.g., the rinsing stage begins before completion of the cleaning stage and continues past termination of the cleaning stage).

The vacuum 26 (FIG. 1) may be fluidly coupled to the vacuum supply line 54 (e.g., a vacuum hose) to provide the vacuum airflow 34 (e.g., vacuum suctioning) within the vacuum chamber 66 and/or to the surface 16 of the object 18. The corresponding vacuum airflow 34 may be directed to the vacuum source 52 (FIG. 1) through one or more vacuum inlet manifolds 85. The vacuum inlet manifold 85 may be located inside the vacuum chamber 66. The vacuum 26 may collect the atomized cleaning medium 30 and dislodged debris 14 (e.g., particles of debris) within the vacuum airflow 34. Thus, the generated mist of cleaning medium 30, captured debris 14 and/or rinsing medium 32 may be substantially instantaneously removed from the cleaning zone 62 by the vacuum airflow 34 upon the cleaning medium 30 and/or rinsing medium 32 being atomized by the acoustic waves 28.

During a cleaning operation, the cleaning head 36 may approximate (e.g., in close proximity to) the surface 16 of the object 18 to be cleaned. The size and/or complexity of the object 18 and/or the location, relative position, orientation angle, and/or distance from the surface 16 of the object 18 may be considered when sizing and configuring the cleaning head 36 for a given cleaning operation. Similarly, the overall size, shape, and configuration of the cleaning head 36 may be configured complementary to the size, shape, complexity and configuration of the object 18 to be cleaned.

Referring to FIG. 1, the cleaning assembly 12 may include a cleaning solution injection unit 56. The cleaning solution injection unit 56 may inject a cleaning solution 84 into the cleaning medium supply line 46 for mixing with the cleaning medium 30 that is provided to the cleaning head 36 (e.g., to the cleaning medium dispenser 22). Alternatively, the cleaning solution 84 may be discharged directly to the surface 16 of the object 18 (e.g., by the cleaning head 36).

The cleaning solution 84 may be provided in a composition that may promote or expedite the cleaning of the object 18. For example, the cleaning solution 84 may include detergent and/or chemicals for injection into the cleaning medium supply line 46, which results in a mixture of molecules of detergent and/or chemicals in the cleaning medium 30. The detergent and/or chemicals may include, but are not limited to, solvents for breaking up or dissolving certain type of debris 14 into smaller debris particles. The detergent and/or chemicals may surround the debris 14 once particles of debris 14 are broken loose from the surface 16 of the object 18 by the acoustic waves 28. The detergent and/or chemicals may encapsulate the debris 14 and prevent the debris 14 from re-attaching to one another and/or re-bonding to the surface 16 of the object 18.

For example, the cleaning solution 84 may include a composition for enhancing the cleaning of certain types of debris 14, such as water- and/or oil-based fluids (e.g., hydraulic fluids and greases). The cleaning solution 84 may be injected into the cleaning medium 30 in a predetermined amount (e.g., upon activation of a release valve). For example, an aqueous cleaning solution may include a mixture of hot water (e.g., cleaning medium 30) and detergents and/or chemicals (e.g., cleaning solution 84) that may penetrate the relatively cooler debris 14 on the surface 16 of the object 18 and may further facilitate dislodgment of the debris 14. In this regard, the cleaning solution 84 may include any one of a variety of other compositions, without limitation, for expediting or enhancing the cleaning of certain types of debris 14.

The cleaning assembly 12 may include a filter 58 and a debris receptacle 60 (e.g., a waste receptacle). The debris receptacle 60 may be coupled to the vacuum supply line 54 for receiving cleaning medium 30, the debris 14 and/or rinsing medium 32 (e.g., water, surfactants, detergent, chemicals, contaminates or other materials) that may be suctioned from the surface 16 of the object 18.

Referring to FIG. 2, the cleaning medium 30 and/or the rinsing medium 32 may facilitate the cleaning action as the droplets of cleaning medium 30 and/or the rinsing medium 32 are atomized into a mist by the acoustic vibrations on the surface 16 of the object 18 and/or through the object 18. One or more acoustic devices (not shown in FIG. 2) may be positioned proximate to (e.g., air-coupled) the object 18 or may be in contact with (e.g., physically coupled) the object 18. For example, the acoustic devices 20 may be mounted and/or connected to one or more holding fixtures 88 (FIG. 1). The acoustic devices 20 may be positioned at a fixed location relative to the object 18 or may be movable (e.g., manually or electromechanically) relative to the object 18 via an associated holding fixture 88.

The ultrasonic devices 20 may be configured to generate a variety of different types of acoustic waves (e.g., sonic waves and/or ultrasonic waves) applied to the surface 16 of the object 18, including, but not limited to, longitudinal waves, shear waves, surface waves and/or plate waves. For example, one or more acoustic devices (e.g., an array of acoustic devices) may be configured to generate acoustic waves 28*a* (e.g., longitudinal and/or shear waves) in the object 18 and one or more acoustic devices (e.g., an array of acoustic devices) may be configured to generate acoustic waves 28*b* (e.g., surface and/or plate waves) on the surface 16 of the object 18.

Those skilled in the art will appreciate that any individual acoustic devices 20, combinations of acoustic devices 20 and/or arrays 38 (e.g., parametric and/or phased arrays) (FIG. 1) of acoustic devices 20 may be configured to generate any combination of acoustic waves 28 (e.g., longitudinal waves and/or shear waves in the object 18 and/or surface waves and/or plate waves on the surface 16 of the object 18). For example, a plurality of acoustic devices 20 (e.g., a parametric and/or phased array of acoustic devices 20) may be tuned and/or positioned to alter wave interference phenomenon in order to create a one or more acoustic interference zones or stress focal points (e.g., at the cleaning zones 62) that may be moved around the object 18 as position, frequency and/or wave mode is changed. The cleaning zone 62 may be moved, through user selection, allowing cleaning at specific points on the surface 16 of the object 18.

For example, the different types of acoustic waves 28 (e.g., longitudinal waves, shear waves, surface waves and/or plate waves) may be generated by adjusting the angles of incidence of the acoustic devices 20 relative to the surface 16 of the object 18. As an example, positioning (e.g., rotating) the acoustic device 20 approximately 10° from normal (e.g., from the plane of the surface 16) may generate plate waves perpendicular to and on the surface 16 of the object 18. As another example, positioning (e.g., rotating) the acoustic device 20 approximately 0° from normal (e.g., parallel to the plane of the surface 16) may generate longitudinal waves in the object 18. As another example, shear waves may be generated under any angle of incidence and may propagate perpendicularly relative to the wave into the object 18. As yet another example, surface waves may be generated under any angle of incidence and may propagate concentrically (e.g., elliptically) on the surface 16 of the object 18.

Additionally, the acoustic devices 20 may also be used for non-destructive inspection of the object 18 and/or structural health monitoring of the object 18. For example, at least two ultrasonic devices 20 (e.g., transmitter and receiver) may be positioned above the surface 16 of the object 18. The positions of the devices 20 may be adjusted relative to each other and relative to and along the surface 16 in order to define the directions of sonic propagation at appropriate angles to generate and detect surface and/or plate waves on the surface 16. The generation and detection of the acoustic waves 28 may depend on several factors including, but not limited to, the elastic properties of the material of the surface 16 and the presence of contamination (e.g., debris 30) and water. A reference library of various patterns of the ultrasonic waves 28 generated and detected by the ultrasonic devices 20 on the reference surfaces may be built and used in non-destructive inspection of the conditions (e.g., cleanliness) of the monitored surface 16 of the object 18.

Figure 3:
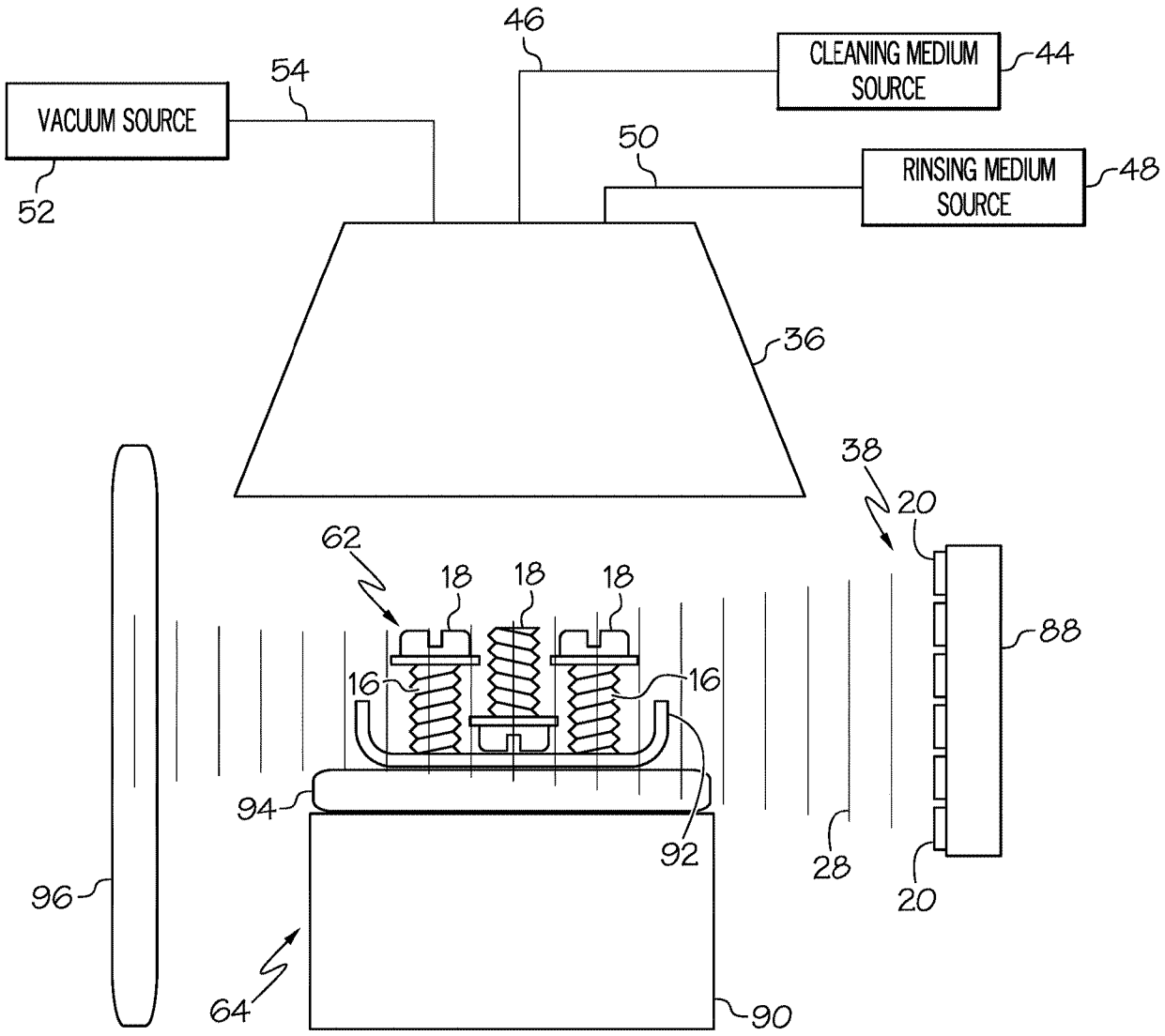
FIG. 3 is a schematic illustration of one implementation of the disclosed system.
Figure 4:
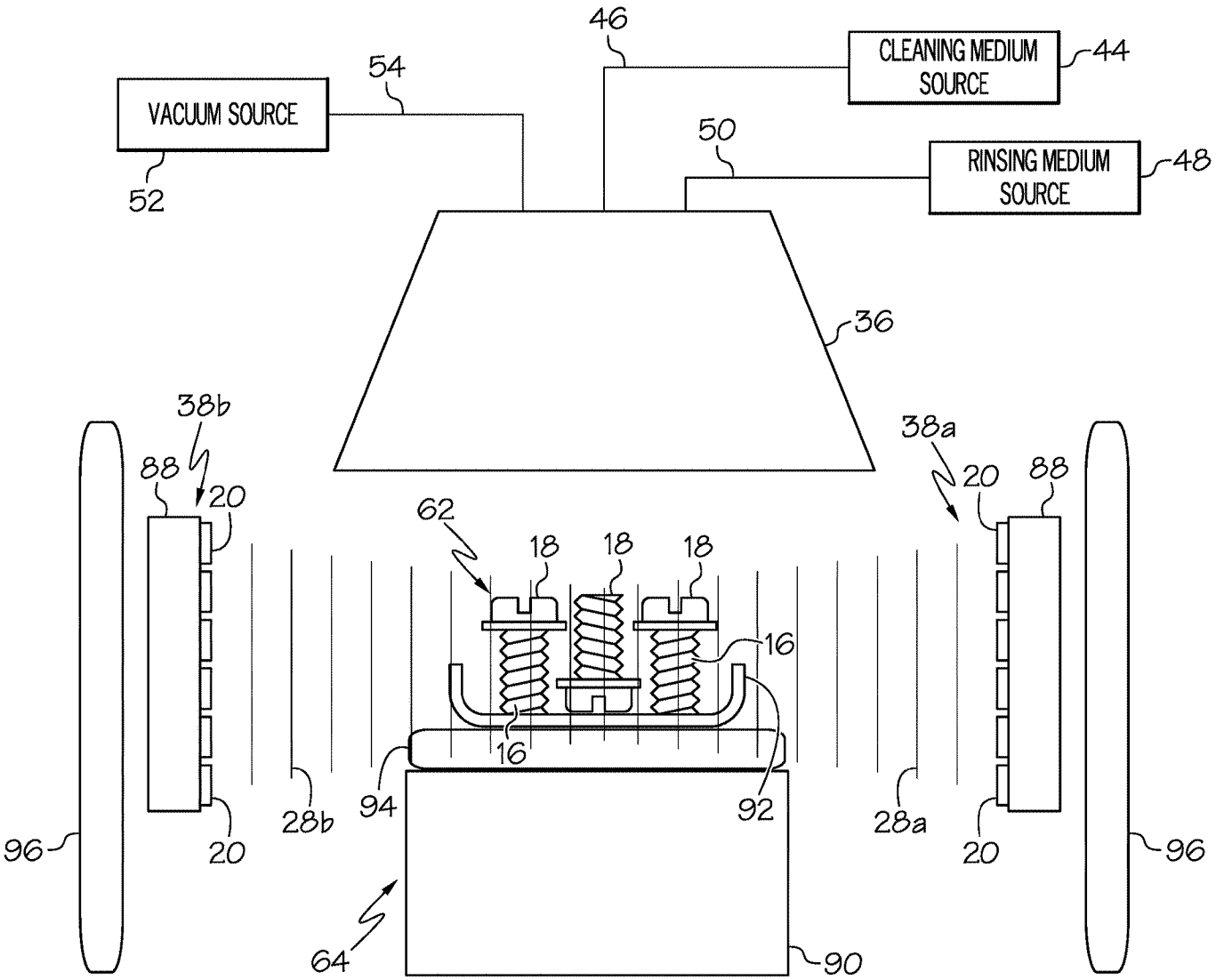
FIG. 4 is a schematic illustration of another implementation of the disclosed system.
Figure 5:
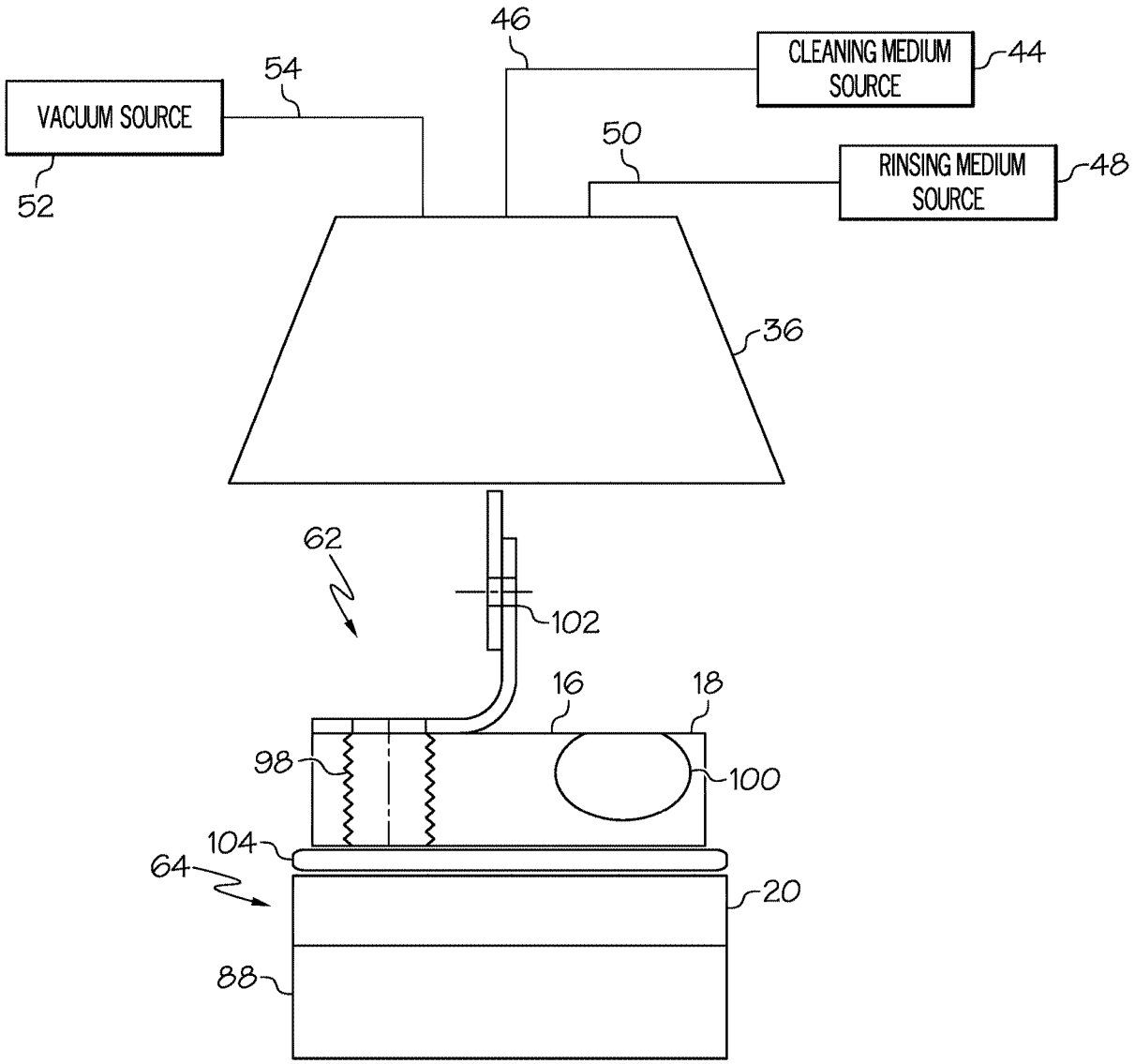
FIG. 5 is a schematic illustration of another implementation of the disclosed system.

Referring to FIGS. 3-5, the disclosed system 10 may be beneficially utilized for cleaning one or more objects 18 having one or more complex surfaces 16. For example and as illustrated in FIGS. 3 and 4, the object 18 may be a fastener, such as a bolt, a screw or the like.

The objects 18 may be placed on, mounted to or otherwise fixed to the holding fixture 64. For example, the holding fixture 64 may include a support stand 90 and the objects 18 may be held within a holder 92, which is held to or supported by the support stand 90. For example, the holder 92 may include an open volume suitable to receive one or more objects 18 (e.g., fasteners). As a specific, non-limiting example, the holder 92 may be a basket having non-solid walls (e.g., mesh walls) suitable to allow the acoustic waves 28 to propagate through the basket and to the objects 18.

The holding fixture 64 may include one or more acoustic absorbers 94. For example, an acoustic absorber 94 may be positioned between the holder 92 and the support stand 90 to absorb acoustic energy and prevent transmission and/or propagation of the acoustic vibrations from the objects 18 to the holding fixture 64.

During a cleaning operation, the cleaning head 36 may be positioned in close proximity to the objects 18 to be cleaned. For example, the cleaning head 36 may be positioned at a suitable position to direct the cleaning medium, rinsing medium and vacuum airflow (not shown in FIGS. 3 and 4) to the surfaces 16 of the objects 18.

At least one acoustic device 20 may be air coupled to the objects 18. For example, the acoustic devices 20 may be positioned in close proximity to the one or more surfaces 16 of the objects 18.

As illustrated in FIG. 3, a plurality of acoustic devices 20 may be configured into an air coupled array 38 (e.g., a parametric or phased array) of acoustic devices 20 configured to direct acoustic waves 28 (e.g., longitudinal waves and/or shear waves) at the surfaces 16 of the objects 18. The acoustic waves 28 may generate acoustic vibrations in the object 18 to dislodge any debris 14 and atomize any cleaning medium 30 and/or rinsing medium 32 (FIG. 1) from the surfaces 16 of the objects 18.

As illustration in FIG. 4, a plurality of acoustic devices 20 may be configured into an air coupled first array 38*a* (e.g., a parametric or phased array) of acoustic devices 20 configured to direct acoustic waves 28*a* (e.g., longitudinal waves and/or shear waves) at the surfaces 16 of the objects 18. A plurality of acoustic devices 20 may be configured into an air coupled second array 38*b* (e.g., a parametric or phased array) of acoustic devices 20 configured to direct acoustic waves 28*b* (e.g., longitudinal waves and/or shear waves) at the surfaces 16 of the objects 18. The first array 38*a* of acoustic devices 20 and the second array 38*b* of acoustic devices 20 may be positioned in generally axially opposed positions, such that acoustic waves 28*a* and acoustic waves 28*b* are focused toward the object 18 and interfere with each other at the object 18. The interfering acoustic waves 28*a* and 28*b* may create specific patterns of acoustic vibrations on the surface 16 of the object 18 to dislodge any debris 14 and atomize any cleaning medium 30 and/or rinsing medium 32 (FIG. 1) from the surfaces 16 of the objects 18.

The plurality of acoustic devices 20 may be mounted to the holding fixture 88. The holding fixture 88 may adjust and/or fix the location, orientation and/or distance of the array 38 of acoustic devices 20 or the first array 38*a* of acoustic devices 20 and second array 38*b* of acoustic devices 20 with respect to the objects 18. The holding fixture 88 may provide for automatic, semi-automatic or manual positioning of the plurality of acoustic devices 20 with respect to the object 18.

One or more acoustic absorbers 96 may be positioned to contain the acoustic waves 28 (FIG. 3) or acoustic waves 28*a* and 28*b* (FIG. 4) within a relatively confined space. For example, one or more acoustic absorbers 96 may be positioned in a generally axially opposed position to the plurality of acoustic devices 20 to absorb the acoustic energy and prevent transmission of the acoustic waves 28 or acoustic waves 28*a* and 28*b* to nearby articles. The acoustic absorber 96 may be mounted to a holding fixture (not shown). The holding fixture may provide for automatic, semi-automatic or manual positioning of the acoustic absorber 96.

Acoustic treatment of the object 18 may energize the cleaning medium 30 and rinsing medium 32 (FIG. 2). For example, the cleaning medium 30 and rinsing medium 32 may be delivered to the surface 16 through an acoustic field generated by the acoustic waves 28 (FIG. 3) or acoustic waves 28*a*, 28*b* (FIG. 4) and may become energized, transferring the acoustic energy directly through the cleaning medium 30 and rinsing medium 32 (e.g., in the form of droplets or thin films).

Referring to FIG. 5, as another example, the object 18 may have a complex shape including a plurality of surface features (e.g. surfaces 16). For example, the object 18 may include one or more through holes 98 (e.g., threaded holes and/or smooth holes), one or more hollow cavities 100 and one or more faying surfaces 102. The object 18 may be mounted to the holding fixture 64 (not shown in FIG. 5).

During a cleaning operation, the cleaning head 36 may be positioned proximate the objects 18 to be cleaned. For example, the cleaning head 36 may be positioned at a suitable position to direct the cleaning medium, rinsing medium and vacuum airflow 34 (not shown in FIGS. 3 and 4) to the surfaces 16 of the object 18.

At least one acoustic device 20 may be air coupled to the object 18. For example, the acoustic devices 20 may be positioned proximate the objects 18 such that an acoustic coupling media 104 (e.g., air) is disposed between the acoustic devices 20 and the object 18. A plurality of acoustic devices 20 may be configured into an air coupled array 38 (e.g., a parametric or phased array) of acoustic devices 20 configured to direct acoustic waves 28 (not shown in FIG. 5) through the object 18 and to the surface 16 of the object 18. The acoustic waves 28 (FIG. 1) may generate acoustic vibrations transferred through the acoustic coupling media 104 and into the object 18 to dislodge any debris 14 and atomize any cleaning medium 30 and/or rinsing medium 32 (FIG. 1) from the surfaces 16 of the object 18.

The plurality of acoustic devices 20 may be mounted to the holding fixture 88. The holding fixture 88 may adjust and/or fix the location, orientation and/or distance of the array 38 of acoustic devices 20 with respect to the objects 18. The holding fixture 88 may provide for automatic, semi-automatic or manual positioning of the plurality of acoustic devices 20 with respect to the object 18.

Figure 6:
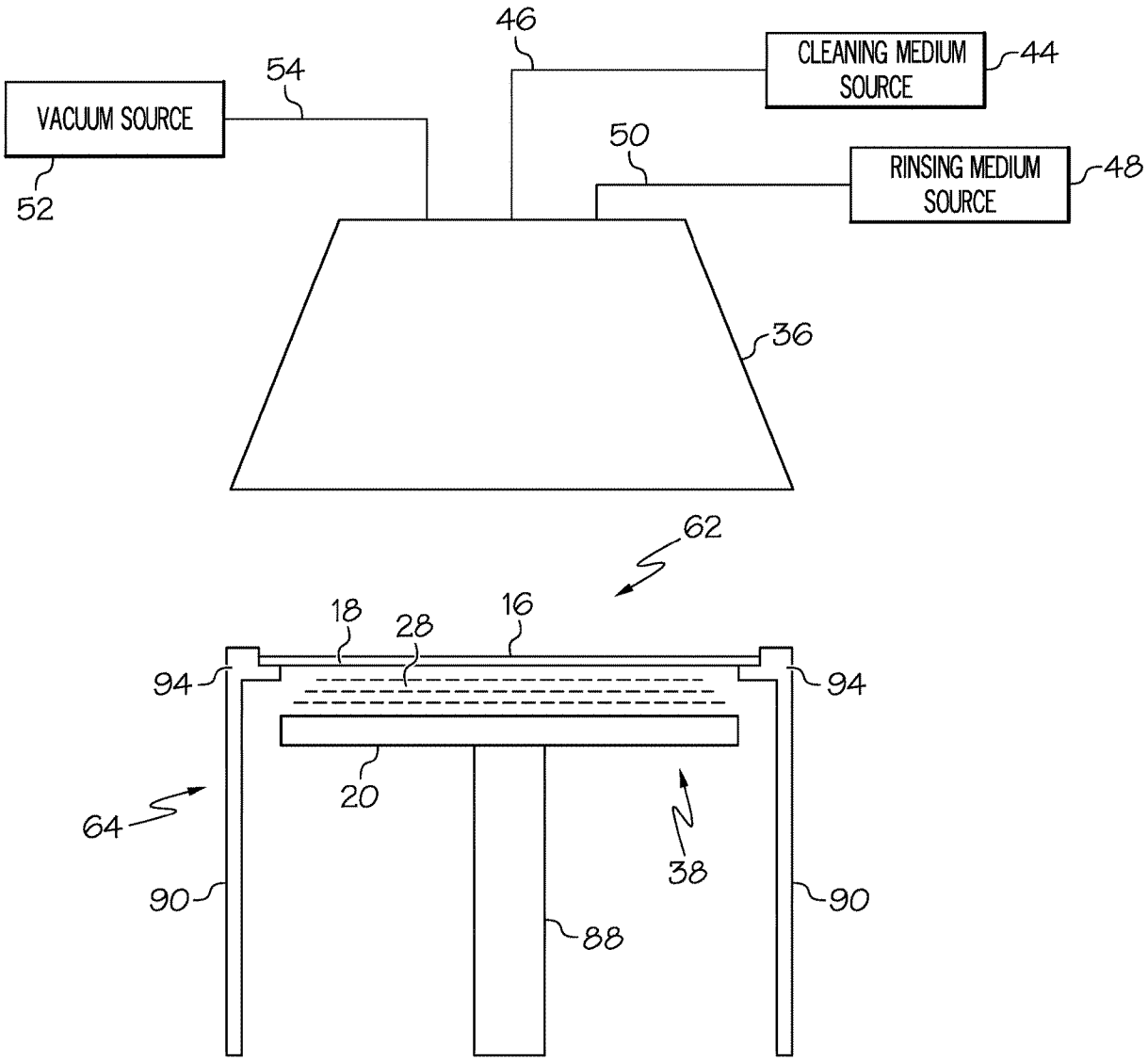
FIG. 6 is a schematic illustration of another implementation of the disclosed system.

Referring to FIG. 6, the disclosed system 10 may be beneficially utilized for precise cleaning one or more objects 18 having one or more delicate surfaces 16. For example, the object 18 may be a silicon wafer having a flat surface.

The object 18 may be mounted to the holding fixture 64. For example, the holding fixture 64 may include a support stand 90 and the objects 18 may be mounted to the support stand 90. The holding fixture 64 may include one or more acoustic absorbers 94. For example, an acoustic absorber 94 may be positioned between the object 18 and the support stand 90 to absorb acoustic energy and prevent transmission and/or propagation of the acoustic vibrations from the object 18 to the holding fixture 64.

During a cleaning operation, the cleaning head 36 may be positioned proximate the surface 16 of the object 18 to be cleaned. For example, the cleaning head 36 may be positioned at a suitable position to direct the cleaning medium, rinsing medium and vacuum airflow (not shown in FIGS. 3 and 4) to the surface 16 of the object 18.

At least one acoustic device 20 may be coupled to the object 18. The acoustic device may be air coupled to the object 18 or may be physically coupled to the object 18. A plurality of acoustic devices 20 may be configured into an acoustically coupled parametric 38 of acoustic devices 20 (e.g., a parametric or phased array) configured to direct acoustic waves 28 (e.g., longitudinal waves and/or shear waves) through the object 18 and to the surface 16 of the object 18. The acoustic waves 28 may generate acoustic vibrations transferred into the object 18 to dislodge any debris 14 and atomize any cleaning medium 30 and/or rinsing medium 32 (FIG. 1) from the surfaces 16 of the object 18.

The plurality of acoustic devices 20 may be mounted to the holding fixture 88. The holding fixture 88 may adjust and/or fix the location, orientation and/or distance of the array 38 of acoustic devices 20 with respect to the objects 18. The holding fixture 88 may provide for automatic, semi-automatic or manual positioning of the plurality of acoustic devices 20 with respect to the object 18.

Referring to FIG. 1, the disclosed system 10 may be incorporated into a robotic assembly 106. The object 18 (e.g., one or more surfaces 16 of the object 18) may be cleaned with by a combination of the acoustic devices 20 and the cleaning head 36 (including the cleaning medium dispenser 22, the rinsing medium dispenser 24 and the vacuum 26). The cleaning head 36 may be moved alongside the object 18 by the robotic assembly 106. A position (e.g., location, orientation and distance) of the cleaning head 36 with respect to the object 18 (e.g., the surface 16 of the object 18) may be set, adjusted and/or maintained by the robotic assembly 106.

Figure 7:
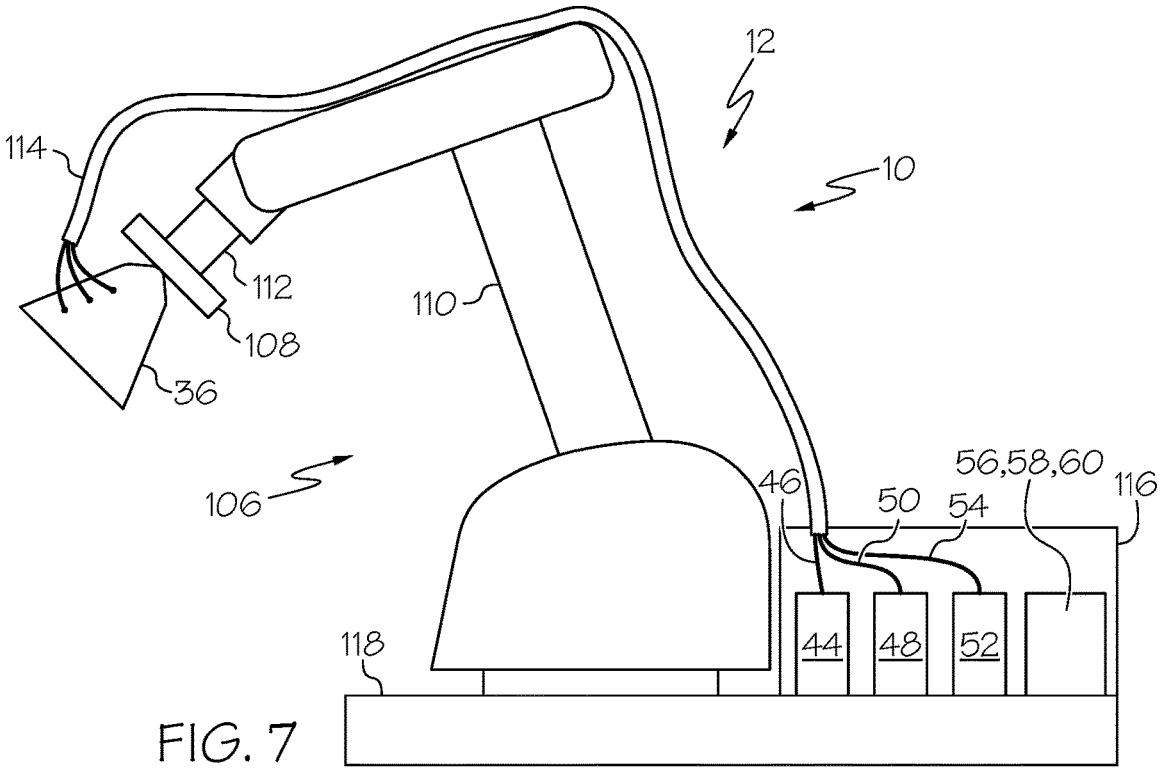
FIG. 7 is a schematic illustration of one aspect of the robotic assembly employed by the disclosed system.

Referring to FIG. 7, the robotic assembly 106 may provide for automated or semi-automated cleaning of one or more objects 18. For example, the cleaning head 36 may be mounted to an end adaptor 108 of a robotic arm 110 of the robotic assembly 106. The end adaptor 108 may be mounted to a movable joint 112 located on an end of the robotic arm 110. The movable joint 112 may facilitate positioning of the cleaning head 36 in a desired position approximating the surface 16 of the object 18 (FIG. 1) being cleaned. The movable joint 112 may include a rotary joint for positioning the cleaning head 36 (e.g., positioning of the end adaptor 108) during cleaning of the surface 16 of the object 18.

A supply line 114 may extend from the cleaning head 36 to a cleaning source 116 that may, for example, be mounted to a base 118 of the robotic assembly 106. The supply line 114 may include the cleaning medium supply line 46, the rinsing medium supply line 50 and the vacuum supply line 54. Similarly, the cleaning source 116 may include the cleaning medium source 44, the rinsing medium source 48 and the vacuum source 52. The cleaning solution injection unit 56, the filter 58 and debris receptacle 60 may be mounted to the robotic assembly 106 (e.g., to the base 118).

Figure 8:
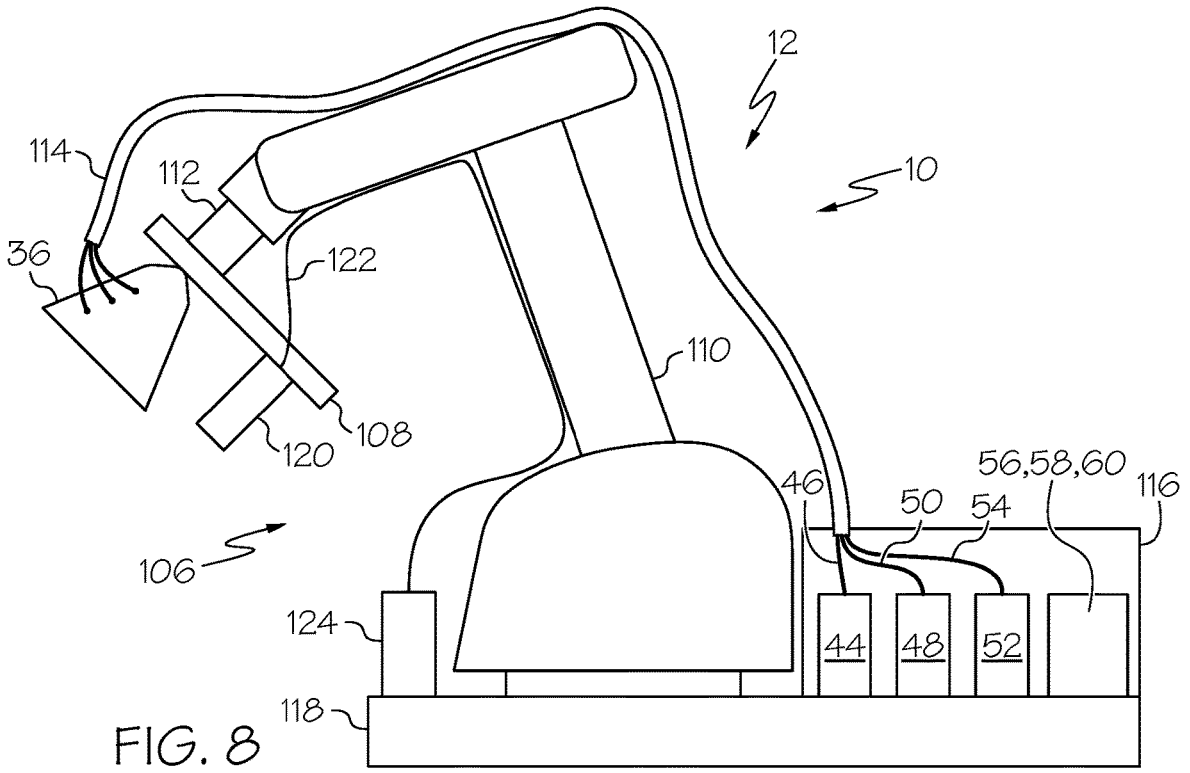
FIG. 8 is a schematic illustration of another aspect of the robotic assembly.

Referring to FIG. 8, the robotic assembly 106 may include one or more manufacturing devices 120 mounted, for example, on the end adaptor 108. The manufacturing device 120 may include a device for performing one or more manufacturing operations on the object 18 (FIG. 1). For example, the manufacturing device 120 may include one or more devices for machining, drilling, painting, sealing, imaging, testing, inspecting, sensing, and other operations on the object 18 (e.g., during fabrication, assembly and/or maintenance). The manufacturing device 120 may be coupled via a supply line 122 to a power supply/material supply unit 124 mounted, for example, to the base 118 of the robotic assembly 106 for delivery of materials and/or power to the manufacturing device 120.

The supply line 122 may deliver lubricant, sealant, coating material, or other materials to the manufacturing device 120. The supply line 122 may also deliver electrical power, pressurized air, hydraulic fluid, and other mediums for operating the manufacturing device 120. The cleaning head 36 may be employed in the robotic assembly 106 to perform a cleaning operation on the object 18 prior to, during or following the performance of one or more manufacturing, inspection, repair, or maintenance operations on the object 18 by one or more of the manufacturing devices 120.

In an example construction, the cleaning head 36 may be removably attached to (e.g., detachable from) the robotic assembly 106 (e.g., the end effector 108 of the robotic arm 110). In order to facilitate detachment of the cleaning head 36 and replacement of a cleaning head 36 having the same or a different configuration, the cleaning head 36 may include at least one end fitting (not shown). For example, the end fitting may be provided as a quick release mechanism. The quick release mechanism may be provided in any one of a variety of configurations for releasably attaching the cleaning head 36 to the supply line 122 and/or the robotic assembly 106. The detachable arrangement of the cleaning head 36 may facilitate mounting of any one of a variety of different cleaning heads 36 having different sizes, shapes, and configurations (e.g., quantity and/or configurations of cleaning medium dispensers 22, rinsing medium dispensers 24 and/or vacuums 26) to correspond to a given cleaning application.

Figure 9:
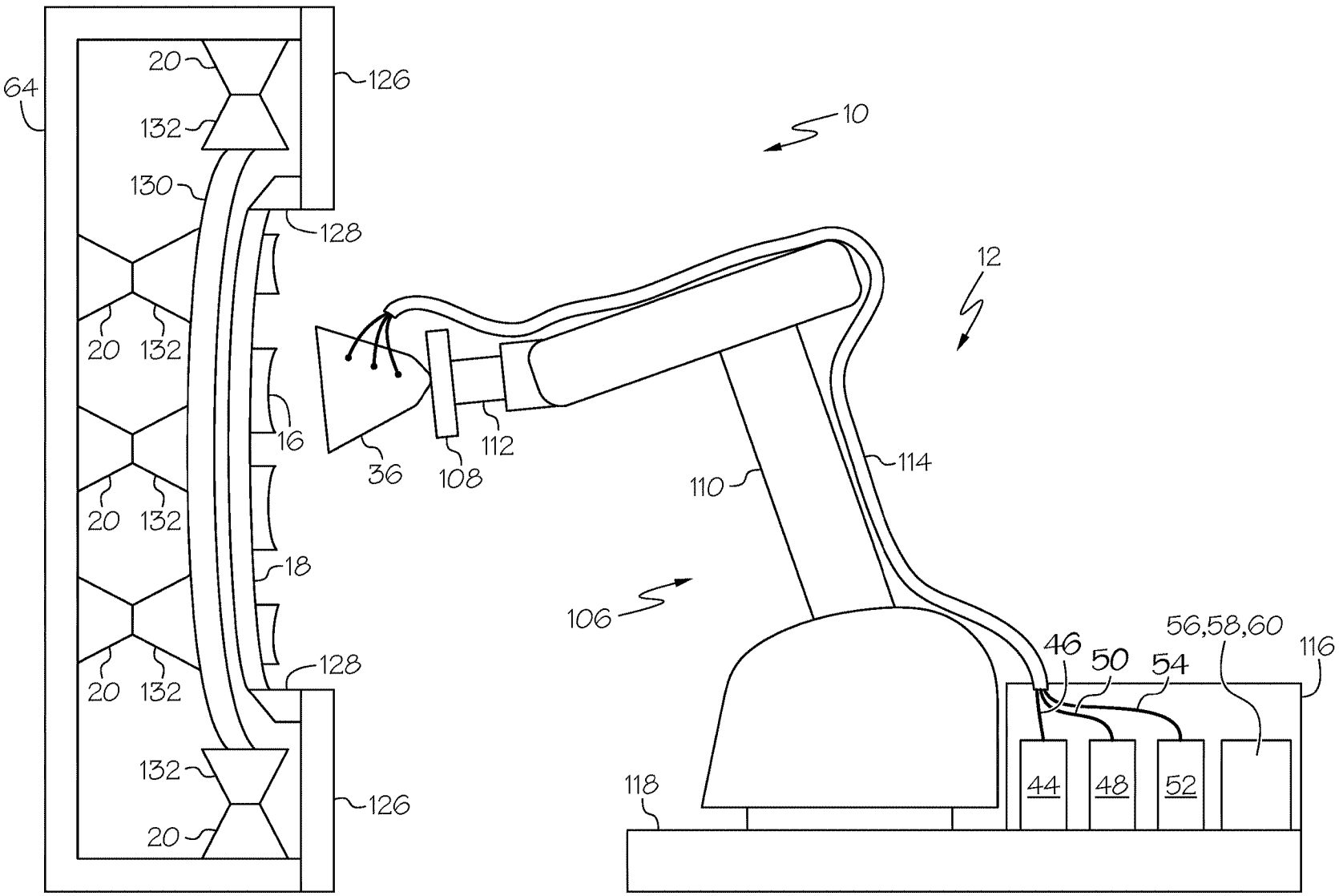
FIG. 9 is a schematic illustration of another implementation of the disclosed system.

Referring to FIG. 9, the holding fixture 64 may be configured to hold and/or support the object 18. For example, the holding fixture 64 may be a component assembly fixture used to hold the object 18 during a fabrication, assembly and/or maintenance operation (e.g., as part of an assembly line) and during a cleaning operation. As another example, the holding fixture 64 may be used to hold the object 18 only during a cleaning operation. As yet another example, the holding fixture 64 may be a part of the object 18.

During a cleaning operation, the cleaning head 36 may be positioned proximate to the surface 16 of the object 18. For example, the robotic assembly 106 may be positioned in close proximity to the holding fixture 64 such that the cleaning head 36 may be positioned at a suitable position to direct the cleaning medium, rinsing medium and vacuum airflow (not shown in FIG. 9) to the surfaces 16 of the object 18.

At least one of the acoustic devices 20 may be physically coupled to the holding fixture 64. The acoustic devices 20 may deliver acoustic waves 28 (FIG. 1) to the object 18 through the holding fixture 64.

The holding fixture 64 may include at least one object holding fixture 126 configured to engage at least a portion (e.g., an edge) of the object 18 to secure the object 18 to the holding fixture 64 and fix the position of the object 18. For example, each object holding fixture 126 may include an edge holding fixture 128 configured to engage at least one edge of the object 18.

The object 18 may be mounted to a support base 130. The object 18 may be in contact with the support base 130 or may be spaced apart a predetermined distance from the support base 130. The holding fixture 64 may include at least one support base holding fixture 132 configured to engage at least a portion of the support base 130 to secure the support base 130 to the holding fixture 64 and fix the position of the object 18.

At least one acoustic device 20 may be coupled to one or more of the object holding fixtures 126 and/or one or more of the support base holding fixtures 132 to transfer acoustic waves 28 (FIG. 1) through the object holding fixtures 126, the support base holding fixtures 132 and/or the support base 130 and into the object 18. The acoustic devices 20 may be physically coupled to the object holding fixtures 126 and/or the support base holding fixtures 132 (e.g., a contact sonic and/or ultrasonic transducer) or air coupled to the object holding fixtures 126 and/or the support base holding fixtures 132 (e.g., a non-contact sonic and/or ultrasonic transducer).

The object holding fixtures 126 and/or the support base holding fixtures 132 may be integral to the holding fixture 64 or may be installed on or connected to the holding fixture 64. The acoustic generator 40 (FIG. 1) may be integral to the holding fixture 64 or may be remote and coupled to the acoustic devices 20.

The object holding fixtures 126, the support base holding fixtures 132 and/or the support base 130 may be acoustically coupled such that the acoustic waves 28 applied to the object holding fixtures 126 and/or the support base holding fixtures 132 sufficiently transfer between and through the holding fixture 64 (including the object holding fixtures 126, the support base holding fixtures 132 and/or the support base 130) and into the object 18.

As used herein, acoustically coupled means that all parts and/or components of the holding fixture 64 are connected together such that the entire construction is acoustically available (e.g., an acoustically resonating system) for effective transmission and propagation of acoustic waves 28. For example, the holding fixture 64 may be constructed such that no gaps occur between components and the propagation of acoustic waves 28 is not lost through component and/or surface interfaces.

Thus, in concert with the acoustic devices 20, the object holding fixtures 126 and/or the support base holding fixtures 132 may form an acoustically resonating system that delivers acoustic waves 28 into and through the entire object 18 to generate acoustic vibrations on the surface 16 of the object 18. The plurality of acoustic devices 20 may be arranged in any configuration (e.g., in a parametric array of acoustic devices or a phased array of acoustic devices).

Each acoustic device 20 may have a fixed position or may be movable with respect to the holding fixture 64, the object holding fixtures 126 and/or the support base holding fixtures 132. For example, the position, orientation and/or location of a plurality of acoustic devices 20 may be fixed to one or more object holding fixtures 126 and/or the support base holding fixtures 132. As another example, the position, orientation and/or location of the acoustic devices 20 may be manually moveable or electromechanically moveable, for example by the holding fixtures 88 (FIG. 1) associated with the acoustic devices 20. Thus, by positioning, activating and tuning the acoustic devices 20, various types of guided acoustic waves 28 (e.g., focused acoustic energy) may be created on the surface 16 of the object 18 at desired locations (e.g., cleaning zones 62).

Those skilled in the art will appreciate that the holding fixture 64 may include any combination of object holding fixtures 126, support base 130 and/or support base holding fixtures 132 having any combination of air coupled acoustic devices 20 and/or physically coupled acoustic devices 20 and the construction illustrated in FIG. 9 is not meant to limit the present disclosure in any manner.

Thus, a plurality of physically coupled acoustic devices 20 may generate acoustic waves 28 directed into the object 18 (e.g., through the holding fixture 64) and/or a plurality of air coupled acoustic devices 20 may generate acoustic waves 28 directed to the surface 16 of the object 18. The interference of the ultrasonic waves 28 may generate longitudinal waves and/or shear waves in the object 18 and/or the plate waves and/or shear waves on the surface 16 of the object 18 to dislodge debris 14 and atomize the cleaning medium 30, debris particles retained by the cleaning medium 30 and the rinsing medium 32.

The power, size, quantity, location, relative position, orientation angle, and distance from the surface 16 of the object 18 may be considered when sizing and configuring the acoustic devices 20 for a given cleaning operation. For example, a relatively small number of ultrasonic devices having high power may be used. As another example, a relatively large number of ultrasonic devices having low power may be used.

Figure 10:
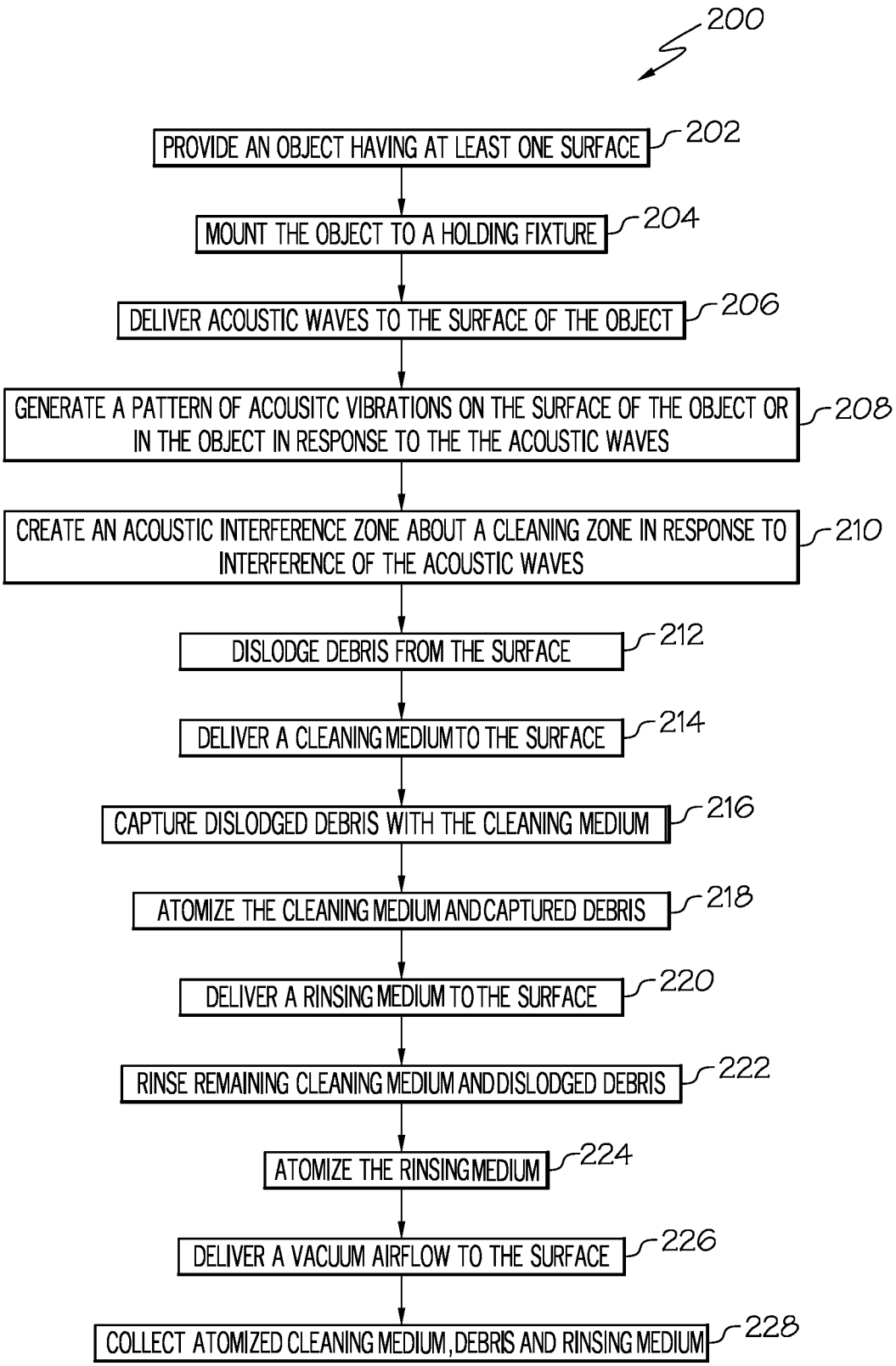
FIG. 10 is a flow diagram of one aspect of the disclosed method for cleaning an object.

Referring to FIG. 10, one aspect of the disclosed method, generally designated 200, for surface cleaning of an object may begin at block 202 by providing an object having at least one surface to be cleaned.

As shown at block 204, the object may be mounted to a holding fixture. The holding fixture may define an acoustically resonate system.

As shown at block 206, acoustic waves (e.g., sonic waves and/or ultrasonic waves) may be delivered to the surface of the object. The acoustic waves may generate acoustic vibrations (e.g., in response to longitudinal waves, shear waves, surface waves and/or plate waves) on the surface of the object. The acoustic waves may be emitted by one or more acoustic devices (e.g., sonic transducers and/or ultrasonic transducer). The acoustic devices may be air coupled to the object and/or the holding fixture and/or physically coupled to the object and/or the holding fixture.

As shown at block 208, the acoustic waves may be focused on a cleaning zone on the surface of the object. As shown at block 210, the focused acoustic waves may generate a pattern of acoustic vibrations on the surface of the object and/or in the object. As shown at block 212, the pattern of acoustic vibrations may create a one or more acoustic interference zones or stress focal points about at least a portion of the surface of the object (e.g., at the cleaning zone) in response to interference of the acoustic waves.

As shown at block 212, any debris on the surface of the object (e.g., within the cleaning zone) may be broken up and/or dislodged from the surface of the object in response to the acoustic vibrations in the object generated by the acoustic waves applied to the object.

As shown at block 214, a cleaning medium (e.g., water or an aqueous cleaning solution) may be delivered to the surface of the object. For example, the cleaning medium may be discharged from a cleaning medium dispenser to the cleaning zone. As shown at block 216, the cleaning medium may capture and/or collect particles of the debris dislodged from the surface of the object by the acoustic waves.

As shown at block 218, the cleaning medium and the particles of debris captured by the cleaning medium (e.g., droplets) may be atomized into a mist in response to the acoustic vibrations in the object generated by the acoustic waves applied to the object.

As shown at block 220, a rinsing medium (e.g., water) may be delivered to the surface of the object. For example, the rinsing medium may be discharged from a rinsing medium dispenser to the cleaning zone. As shown at block 222, the rinsing medium may rinse any remaining cleaning medium and/or particles of the debris from the surface of the object.

As shown at block 224, the rinsing medium may be atomized into a mist in response to the acoustic vibrations in the object generated by the acoustic waves applied to the object.

As shown at block 226, a vacuum airflow may be delivered to the surface of the object. As shown at block 228, the atomized mist of cleaning medium, debris particles captured by the cleaning medium and/or the rinsing medium may be collected by the vacuum airflow. The vacuum step shown at block 220 may be performed during and/or throughout the steps shown at blocks 210-218.

Accordingly, the disclosed system and method may be used to clean one or more surfaces of a large and/or complex object by combining acoustic vibrations (e.g., via focused acoustic waves), a cleaning medium, a rinsing medium and a vacuum airflow. A plurality of acoustic devices (e.g., an array of acoustic devices) may generate and emit directional acoustic waves that are electronically and mechanically focused on particular areas (e.g., a cleaning zone) on the surface of the object. Activating and tuning the acoustic devices by various electronic and mechanical means may create desired patterns of acoustic vibrations in and on the object to achieve the cleaning effect. As an example, positioning and focusing of the acoustic waves may be achieved through movement of various cleaning heads equipped with cleaning medium dispensers, rinsing medium dispenser and vacuums and/or holding fixtures equipped with acoustic devices. Tuning of the acoustic devices may be achieved with the concept of parametric or phased array to achieve acoustic streaming in the cleaning medium and the rinsing medium.

Referring generally to FIG. 1, the various aspects of the disclosed system 10 for cleaning an object including a surface may include an acoustic device 20 configured to deliver acoustic waves 28 to the object 18, a fluid dispenser 134 configured to deliver a fluid 136 to the surface 16, a vacuum 26 configured to deliver a vacuum airflow 34 proximate the surface 16, wherein the acoustic waves 28 dislodge debris 14 from the surface 16, acoustically treat the fluid 136, and atomize the fluid 136 and the debris 14 collected by the fluid 136.

In one aspect, the acoustic waves 28 may generate acoustic vibrations on the surface 16 of said object 18. The acoustic waves 28 may generate ultrasonic vibrations in the object 18. The acoustic waves 28 may include at least one of longitudinal waves, shear waves, surface waves and plate waves.

In another aspect, the fluid 136 may include a cleaning medium and a rinsing medium.

In another aspect, a position of said acoustic device 20, a position of the fluid dispenser 134 and a position of the vacuum 26 may be adjustable with respect to the surface 16.

In another aspect, the fluid dispenser 134 may include a cleaning medium dispenser 22 configured to deliver a cleaning medium 30 to the surface 16 and a rinsing medium dispenser 24 configured to deliver a rinsing medium 32 to the surface 16. The cleaning medium dispenser 22, the rinsing medium dispenser 24 and the vacuum 26 may be mounted to a cleaning head 36. The cleaning head 36 may be mounted to a robotic assembly 106, wherein the robotic assembly 106 positions the cleaning head 36 with respect to the surface 16. The cleaning medium 30 may include at least one of a liquid and a gas, and the rinsing medium 32 may include at least one of a liquid and a gas. The cleaning medium 30 and the rinsing medium 32 may include different compositions.

In another aspect, the acoustic waves 28 may reduce adhesion between the debris 14 and the surface 16. The fluid 136 may collect the debris 14 dislodged from the surface 16. The acoustic waves 28 may be focused on a cleaning zone 62 on the surface 16.

In another aspect, the acoustic device 20 may include at least one of a sonic transducer and an ultrasonic transducer.

In another aspect, the disclosed system 10 may include a plurality of acoustic devices 20 arranged as an array of acoustic devices 38. The array of acoustic devices 38 may be air coupled to the object 18. The array of acoustic devices 38 may deliver focused acoustic waves 28 to the surface 16. Interference of the focused acoustic waves 28 may define an acoustic wave interference zone on the surface 16. The array of acoustic devices 38 may include at least one of a parametric array and a phased array.

In another aspect, the disclosed system 10 may include a plurality of acoustic devices 20 arranged as a first array of acoustic devices 38*a* and a second array of acoustic devices 38*b*. The first array of acoustic devices 38*a* may be air coupled to the object 18. The second array of acoustic devices 38*b* may be physically coupled to the object 18.

In another aspect, the disclosed system 10 may include a holding fixture 64 configured to hold the object 18. The acoustic waves 28 may generate the acoustic vibrations in the object 18. The fluid dispenser 134 may include a cleaning medium dispenser 22 configured to deliver a cleaning medium 30 to the surface 16 and a rinsing medium dispenser 24 configured to deliver a rinsing medium 32 to the surface 16. The cleaning medium dispenser 22, the rinsing medium dispenser 24 and said vacuum 26 may be mounted to a cleaning head 36. The acoustic device 20 may be coupled to the holding fixture 56. A position of the cleaning head 36 may be adjustable with respect to the object 18. The acoustic device 20 may be physically coupled to the holding fixture 64. The acoustic device 20 may be air coupled to at least one of the holding fixture 64 and the object 18. A plurality of acoustic devices 20 may be arranged as a first array of acoustic devices 38*a* and a second array of acoustic devices 38*b*. The first array of acoustic devices 38*a* may be physically coupled to the holding fixture 64. The second array of acoustic devices 38*b* may be air coupled to at least one of the holding fixture 64 and the object 18. The holding fixture 64 may define an acoustically resonating system. The holding fixture 64 may be a part of said object.

In another aspect, the fluid 136 may include at least one of a liquid and a gas. The fluid 136 may include at least one of water and an aqueous solution.

In another aspect, the disclosed system 10 may include an acoustic device 20 configured to deliver acoustic waves 28 to the object 18, a cleaning medium dispenser 22 configured to deliver a cleaning medium 30 to the surface 16, a rinsing medium dispenser 24 configured to deliver a rinsing medium 32 to the surface 16, and a vacuum 26 configured to deliver a vacuum airflow 34 proximate the surface 16. The acoustic waves 28 may generate acoustic vibrations in the object 18 to dislodge debris from the surface 16, acoustically treat the cleaning medium 30 and the rinsing medium 32, and atomize the cleaning medium 30, the debris 14 collected by the cleaning medium 30 and the rinsing medium 32.

Referring generally to FIGS. 1 and 10, one aspect of the disclosed method 200 for cleaning an object including a surface may include: (1) delivering acoustic waves 28 to the object 18 to dislodge debris 14 from the surface 16, (2) delivering a cleaning medium 30 to the surface 16 to collect dislodged debris 14, delivering the acoustic waves 28 to the object 18 to acoustically treat and atomize the cleaning medium 30 and the dislodged debris 14, (3) applying a vacuum airflow 34 to collect atomized cleaning medium 30 and dislodged debris 14, (4) delivering a rinsing medium 32 to the surface 16, (5) delivering the acoustic waves 28 to the object 18 to acoustically treat and atomize the rinsing medium 32, and applying the vacuum airflow 34 to collect atomized rinsing medium 32.

In another aspect, the acoustic waves 28 may generate acoustic vibrations in the object 18.

In another aspect, the disclosed method 200 may include the steps of: (6) mounting the object 18 to a holding fixture 64, and (7) delivering the acoustic waves 28 to at least one of the holding fixture 64 and the object 18 to generate acoustic vibrations in the object 18. The holding fixture 64 may define an acoustically resonating system.

In another aspect, the disclosed method 200 may include the steps of: (8) focusing the acoustic waves 28 on the cleaning zone 62 on the surface 16, and generating a pattern of the acoustic vibrations in the object 18. The step of generating the pattern of the acoustic vibrations may include defining an acoustic interference zone on at least a portion of the surface 16 through interference of the acoustic waves 28.

In another aspect, the acoustic waves 28 may reduce adhesion between the debris 14 and the surface 16. The cleaning medium 30 may include at least one of a liquid and a gas. The rinsing medium 32 may include at least one of a liquid and a gas.

In another aspect, the steps of delivering the cleaning medium 30 and delivering the rinsing medium 32 may occur consecutively.

In another aspect, the steps of delivering the cleaning medium 30 and delivering the rinsing medium 32 may occur simultaneously.

Figure 11:
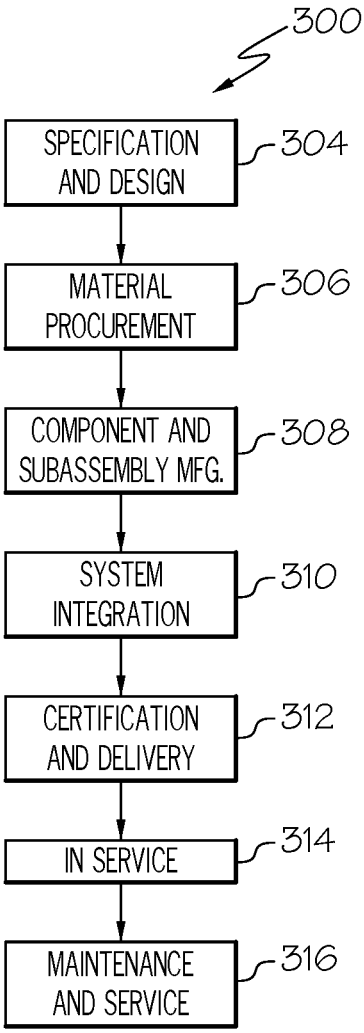
FIG. 11 is flow diagram of an aircraft production and service methodology.
Figure 12:
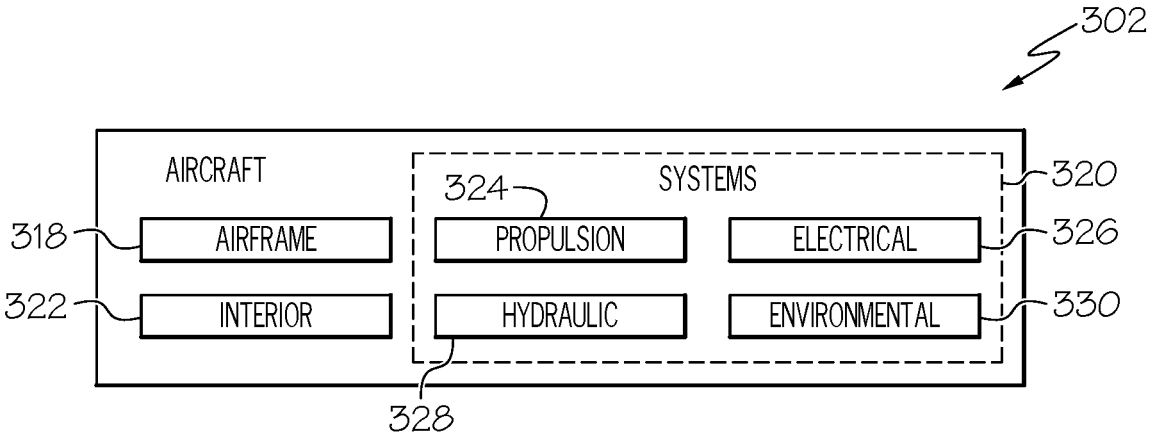
FIG. 12 is a block diagram of an aircraft.

Examples of the disclosure may be described in the context of an aircraft manufacturing and service method 300, as shown in FIG. 11, and an aircraft 302, as shown in FIG. 12. During pre-production, the aircraft manufacturing and service method 300 may include specification and design 304 of the aircraft 302 and material procurement 306. During production, component/subassembly manufacturing 308 and system integration 310 of the aircraft 302 takes place. Thereafter, the aircraft 302 may go through certification and delivery 312 in order to be placed in service 314. While in service by a customer, the aircraft 302 is scheduled for routine maintenance and service 316, which may also include modification, reconfiguration, refurbishment and the like.

Each of the processes of method 300 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 12, the aircraft 302 produced by example method 300 may include an airframe 318 with a plurality of systems 320 and an interior 322. Examples of the plurality of systems 320 may include one or more of a propulsion system 324, an electrical system 326, a hydraulic system 328, and an environmental system 330. Any number of other systems may be included. Although an aerospace example is shown, the principles of the disclosed system 10 and method 200 may be applied to other industries, such as the automotive and the semiconductor industries.

Apparatus and methods embodied herein may be employed during any one or more of the stages of the production and service method 300. For example, components or subassemblies corresponding to component/subassembly manufacturing 308, system integration 310, and or maintenance and service 316 may be fabricated or manufactured using the disclosed system 10 and method 200. Also, one or more apparatus examples, method examples, or a combination thereof may be utilized during component/subassembly manufacturing 308 and/or system integration 310, for example, by substantially expediting assembly of or reducing the cost of an aircraft 302, such as the airframe 318 and/or the interior 322. Similarly, one or more of apparatus examples, method examples, or a combination thereof may be utilized while the aircraft 302 is in service, for example and without limitation, to maintenance and service 316.

Although various aspects of the disclosed system and method have been shown and described, modifications may occur to those skilled in the art upon reading the specification. The present application includes such modifications and is limited only by the scope of the claims.

What is claimed is:

1. A method for cleaning an object comprising a surface, said method comprising:

positioning an acoustic device relative to said object, wherein said acoustic device is positioned at a distance from said surface;

positioning an acoustic absorber relative to said object and relative to said acoustic device;

transmitting waves of acoustic energy from said acoustic device along a travel path to said object to dislodge debris from said surface, wherein said waves of acoustic energy have a frequency that is tuned to generate acoustic vibrations through said object and on said surface;

containing said waves of acoustic energy in a confined space, wherein said acoustic absorber is spaced away from said acoustic device in said travel path of said waves of acoustic energy so that said object is located between said acoustic device and said acoustic absorber;

positioning a cleaning head relative to said object, wherein said cleaning head is separate from said acoustic device and comprises a vacuum chamber, a first nozzle located within said vacuum chamber, and a second nozzle located within said vacuum chamber;

delivering a cleaning medium from said first nozzle to said surface to collect dislodged debris;

transmitting said waves of acoustic energy from said acoustic device to said object to atomize said cleaning medium and said dislodged debris collected in said cleaning medium;

applying a vacuum to said vacuum chamber to collect atomized cleaning medium and dislodged debris;

delivering a rinsing medium from said second nozzle to said surface;

transmitting said waves of acoustic energy from said acoustic device to said object to atomize said rinsing medium; and applying said vacuum to said vacuum chamber to collect atomized rinsing medium.

2. The method of claim 1, wherein said waves of acoustic energy comprise one of longitudinal waves, shear waves, surface waves, and plate waves.

3. The method of claim 1, further comprising mounting said object to a holding fixture.

4. The method of claim 1, further comprising focusing said waves of acoustic energy at a cleaning zone on said surface.

5. The method of claim 4, further comprising generating a pattern of acoustic vibrations in said object.

6. The method of claim 5, wherein said generating said pattern of acoustic vibrations comprises defining an acoustic interference zone on at least a portion of said surface of said object through interference of said waves of acoustic energy.

7. The method of claim 1, wherein said waves of acoustic energy reduce adhesion between said debris and said surface.

8. The method of claim 1, wherein said cleaning medium and said rinsing medium comprise at least one of a liquid and a gas.

9. The method of claim 1, wherein said delivering said cleaning medium and said delivering said rinsing medium occur consecutively.

10. The method of claim 1, wherein said delivering said cleaning medium and said delivering said rinsing medium occur simultaneously.

11. The method of claim 1, wherein said frequency of said waves of acoustic energy is further tuned to break said debris into particles of debris.

12. The method of claim 1, wherein:

said delivering said cleaning medium from said first nozzle to said surface comprises delivering said cleaning medium as droplets; and said droplets capture said dislodged debris.

13. The method of claim 12, wherein said transmitting said waves of acoustic energy from said acoustic device to said object to atomize said cleaning medium and said dislodged debris comprises generating a mist that contains said dislodged debris from said droplets.

14. The method of claim 13, wherein said applying said vacuum to said vacuum chamber to collect said atomized cleaning medium and said dislodged debris comprises collecting said mist.

15. The method of claim 3, further comprising positioning a second acoustic absorber between said holding fixture and said object.

16. The method of claim 1, wherein:

the acoustic device comprises an array of ultrasonic transducers; and said transmitting said waves of acoustic energy from said acoustic device to said object comprises focusing said waves of acoustic energy through said object to generate a focal pattern of acoustic vibrations on said surface due to interference of focused waves of acoustic energy.

17. The method of claim 1, wherein said waves of acoustic energy comprise a combination of at least two of longitudinal waves, shear waves, surface waves, and plate waves.

18. The method of claim 1, further comprising:

positioning a second acoustic device relative to said object, wherein said second acoustic device is positioned at a second distance from said surface;

positioning a second acoustic absorber relative to said object and relative to said second acoustic device;

transmitting second waves of acoustic energy from said second acoustic device along a second travel path to said object to dislodge debris from said surface, wherein said second waves of acoustic energy have a second frequency that is tuned to generate second acoustic vibrations through said object and on said surface; and containing said second waves of acoustic energy in said confined space, wherein said second acoustic absorber is spaced away from said second acoustic device in said second travel path of said second waves of acoustic energy so that said object is located between said second acoustic device and said second acoustic absorber.

19. The method of claim 18, further comprising generating a pattern of said acoustic vibrations and said second acoustic vibrations to define an acoustic interference zone on at least a portion of said surface of said object through interference of said waves of acoustic energy and said second waves of acoustic energy.

20. The method of claim 1, further comprising atomizing said cleaning medium to generate a mist that contains said dislodged debris.

* * * * *